US007515150B2

(12) United States Patent
Abe et al.

(10) Patent No.: US 7,515,150 B2
(45) Date of Patent: Apr. 7, 2009

(54) SEMICONDUCTOR DEVICE CAPABLE OF SUPPRESSING VARIATION OF CURRENT OR VOLTAGE TO BE SUPPLIED TO EXTERNAL CIRCUIT

(75) Inventors: Katsumi Abe, Tokyo (JP); Masamichi Shimoda, Tokyo (JP)

(73) Assignees: NEC Corporation, Tokyo (JP); NEC Electronics Corporation, Kawasaki (JP)

( * ) Notice: Subject to any disclaimer, the term of this patent is extended or adjusted under 35 U.S.C. 154(b) by 779 days.

(21) Appl. No.: 10/942,760

(22) Filed: Sep. 16, 2004

(65) Prior Publication Data

US 2005/0062128 A1 Mar. 24, 2005

(30) Foreign Application Priority Data

Sep. 22, 2003 (JP) ..... 2003-329552

(51) Int. Cl.
*G09G 5/00* (2006.01)

(52) U.S. Cl. ..... 345/212; 345/205; 345/206; 345/45; 345/55; 345/60

(58) Field of Classification Search ..... 345/205–206, 345/45, 55, 60, 212
See application file for complete search history.

(56) References Cited

U.S. PATENT DOCUMENTS 6,204,567 B1 * 3/2001 Imamura ..... 257/797
6,768,482 B2 * 7/2004 Asano et al. ..... 345/90
6,825,834 B2 * 11/2004 Miyajima ..... 345/204

FOREIGN PATENT DOCUMENTS

| | | |
|---|---|---|
| JP | 07-094601 | 4/1995 |
| JP | 2002-009247 | 1/2002 |
| JP | 2002-049330 | 2/2002 |
| JP | 2002-196697 | 7/2002 |

OTHER PUBLICATIONS

Akira Yumotoet al. Pixel-Driving Methods for Large-Sized Poly-Si AM-OLED Displays. Sony Corporation Core Technology & Netowrk Companypp. 1395-1398 2001.

* cited by examiner

*Primary Examiner*—Richard Hjerpe
*Assistant Examiner*—Leonid Shapiro
(74) *Attorney, Agent, or Firm*—Katten Muchin Rosenman LLP

(57) ABSTRACT

A semiconductor device is capable of suppressing variations of a current or a voltage to be supplied to an external circuit. The semiconductor device has a plurality of unit areas arrayed in one direction, and components in the unit areas are arranged in the same shape and the same layout in the unit areas. A holding capacitor for holding a voltage is surrounded by an interconnect kept at ground potential. Interconnects at ground potential are inserted in areas where reference current interconnects for supplying reference currents to functional blocks (1-bit DCC circuit regions) and gradation digital data interconnects and storage timing signal interconnects cross each other vertically, the interconnects being disposed between these reference current interconnects, gradation digital data interconnects and storage timing signal interconnects.

18 Claims, 19 Drawing Sheets

SEMICONDUCTOR DEVICE CAPABLE OF SUPPRESSING VARIATION OF CURRENT OR VOLTAGE TO BE SUPPLIED TO EXTERNAL CIRCUIT

BACKGROUND OF THE INVENTION

1. Field of the Invention:

The present invention relates to a semiconductor device having, on a principal surface of a substrate, a plurality of functional blocks each having a function to hold either a voltage determined by a current supplied from a current source or a voltage supplied from a voltage source and to supply a current or a voltage determined by the voltage thus held to an external circuit, and more particularly to a semiconductor device having a layout suitable for use as a driver for a display apparatus, and a display apparatus employing such a semiconductor device.

2. Description of the Related Art

Semiconductor devices having a matrix of current-driven load elements such as OLED (Organic Light-Emitting Diodes) typified by organic EL (Electro Luminescent) elements employ driving semiconductor devices for supplying currents to drive those current-driven load elements. The driving semiconductor devices have a plurality of functional blocks having a function to hold voltages corresponding to currents to flow through the OLED elements and a function to supply currents according to the voltages that are held.

Heretofore, there has been disclosed a display apparatus having a driving semiconductor device for inputting either gradation currents equal to gradation currents to flow through OLED elements or gradation currents proportional thereto to functional blocks, as shown in A. Yumoto, et al., "Pixel-Driving Methods for Large-Sized Poly-SiAM-OLED displays", IDW '01, 1395-1398 pages.

The driving semiconductor device serves as a current-program-type data line driver, and has m circuit blocks for holding voltages corresponding to gradation currents supplied from an external circuit and providing current determined by the voltages that are held to 3 m data lines. A display apparatus includes a display unit having m pixels each comprising R (red), G (green), and B (blue) sub pixels, per horizontal (scanning) line. A single data line is connected to each of the sub pixels.

FIG. 1 of the accompanying drawings is a circuit diagram of an ith circuit block for providing currents to three data lines that are connected to an ith pixel on one horizontal line, where i represents a positive integer satisfying $i \leqq m$. The circuit block has three pairs of a current copier current output circuit (hereinafter referred to as "cell A") comprising four transistors Tr101A through Tr104A in the form of N-channel FETs and a single holding capacitor C101, and a current copier current output circuit (hereinafter referred to as "cell B") comprising four transistors Tr101B through Tr104B in the form of N-channel FETs and a single holding capacitor C101. The three pairs of current output circuits have respective output terminals, which are successively arranged from left to right in FIG. 1, electrically connected respectively to data lines that are connected to R, G, and B sub pixels of the ith pixel. Each of cells A, B serves as a minimum functional block. Transistors Tr102A, Tr102B of cells A, B have respective drains connected to a signal line which is supplied with gradation current Iini. Transistors Tr104A, Tr104B have respective gates supplied with respective data enable signals DEA, DEB. One of data enable signals DEA, DEB is of a high level and the other of a low level, and they are reversed each time a horizontal line in the display unit is selected.

FIG. 2 of the accompanying drawings is a timing chart which is illustrative of operation of the circuit clock shown in FIG. 1. In a horizontal period where data enable signal DEA is of a low level and data enable signal DEB is of a high level (horizontal period A in FIG. 2), cells A are supplied with gradation current Iini in response to storage timing signals MARi, MAGi, MABi. Specifically, storage timing signal MARi goes high at first, and gradation current Iini is supplied which corresponds to a current to pass through the OLED element of ith R sub pixel on a horizontal line next the horizontal line that is being selected. In cell A corresponding to R sub pixel, since transistors Tr102A, Tr103A are turned on, gradation current Iini flows into holding capacitor C101, charging holding capacitor C101. In a stable state, holding capacitor C101 holds a voltage between the gate and source of transistor Tr102A (across holding capacitor C101) for passing gradation current Iini between the source and drain of transistor Tr102A. When the stable state is reached, storage timing signal MARi goes low, and at the same time storage timing signal MAGi goes high. As with cell A corresponding to R sub pixel, a voltage is held between the source and drain of transistor Tr101A of cell A corresponding to G sub pixel. Then, a voltage is similarly held between the source and drain of transistor Tr101A of cell A corresponding to B sub pixel.

Such a process of holding a voltage is performed in the same horizontal period from the first circuit block to the mth circuit block. At this time, storage timing signals MBRi, MBGi, MbBi that are applied to the gates of transistors Tr102B, Tr103B of cell B are of a low level.

Since transistors Tr102B, Tr103B are turned off, therefore, no gradation current flows into cell B. As transistor Tr101B is turned on, currents IRi, IGi, IBi ($i=1, 2, \ldots, m$) corresponding to voltages held by holding capacitors C101 of cells B from the first circuit block to the mth circuit block in the preceding frame are supplied to the data lines, energizing the OLED elements of the sub pixels on a horizontal line which are connected to the data lines.

In a next horizontal period (horizontal period B in FIG. 2), data enable signal DEA goes high and data enable signal DEB goes low, and transistors Tr101A supply the data lines with currents according to the voltages held in the preceding horizontal period. At the same time, as with transistor Tr101A in the preceding horizontal period, transistors Tr101B hold voltages corresponding to currents to pass through the OLED elements on a horizontal line to be selected next.

In this manner, the supply of currents corresponding to voltages held by transistors Tr101B or Tr101A to the data lines in the preceding horizontal period and the holding of voltages corresponding to currents to be supplied to the data lines in the next horizontal period in transistors Tr101A or Tr101B are switched between cell A and cell B in every horizontal period for thereby displaying information on the display unit.

Driving semiconductor devices such as the above current-program-type data line driver and source drivers for driving liquid crystal display apparatus include analog circuits such as current copier current output circuits and DACs (Digital-to-Analog Converters). The layout of these analog circuits are required to keep the layout area prevented from increasing and also to increase the accuracy, and often incorporate a mirror configuration.

FIG. 3 of the accompanying drawings shows a conventionally designed layout of the circuit block of the current-program-type data line driver shown in FIG. 1. The semiconductor device in the layout shown in FIG. 3 is fabricated on a glass substrate of thin-film transistors made of low-temperature poly-Si (polycrystalline Silicon). The semiconductor device has a first interconnect layer and a second interconnect layer. The first interconnect layer includes interconnects for supplying storage timing signals and data enable signals to the cells, and the second interconnect layer includes interconnects for supplying gradation currents and GND interconnects.

The layout of circuit block 201 shown in FIG. 3 resides in that two cells A, B of the same structure are arranged in a mirror configuration as a current copier current output circuit pair with respect to each data line. Each of areas including transistors and holding capacitors C101 is also arranged in a mirror configuration. These arrangements are effective to reduce variations and errors due to layout differences and increase operational accuracy.

By arranging current copier current output circuit pairs connected to data lines that correspond to successive R, G, B sub pixels in mirror-reversed layouts, adjacent current copier current output circuits that are connected to different data lines can share data enable signals DEA, DEB.

Therefore, a single circuit block requires only four data enable signal lines, making it possible to reduce the layout area, although it would require two data enable signal lines for each current copier current output circuit pair and hence a total of 6 data enable signal lines if not designed in a mirror-reversed layout.

If gradation current Iini is supplied from a source-type current source, then currents IRi, IGi, IBi supplied to the data lines are actually currents drawn from the data lines to the source of transistor Tr4A or Tr4B. Depending on the circuit arrangement, currents are discharged to the data lines or drawn from the data lines. In any case, the expression that currents are supplied to the data lines will be used below.

The conventional semiconductor device described above has suffered the following problems:

The first problem is that the conventional mirror layout poses limitations on efforts to increase the accuracy of the gradation current and achieve more gradations with the gradation current. With the mirror layout, cells A, B connected to the same data line, including interconnects, are arranged symmetrically with respect to their central axis, but are not arranged identically as viewed from the same direction in which cells A, B are arrayed. Therefore, if the manufacturing process that is used is directional, e.g., if the process characteristics are a function of the position between two adjacent cells A, B, then the operational characteristics are highly likely to differ between such two adjacent cells A, B.

For example, in the above conventional example, the left current copier current output circuit (cell A or cell B) of the current copier current output circuit pair shown in FIG. 3 has one interconnect on the left of holding capacitor C101 and two interconnects on the right of holding capacitor C101, whereas the right current copier current output circuit (cell B or cell A) has two interconnects on the left of holding capacitor C101 and one interconnect on the right of holding capacitor C101. Therefore, if the manufacturing process is directional, then the capacitances between the two adjacent cells suffer process-dependent characteristic variations, resulting in a reduction in the output accuracy.

Furthermore, if interconnects are shared by mirror-reversed circuits in the above conventional design, then the relationship between the cells and the interconnects may vary between the cells. For example, with the circuit block 201 shown in FIG. 3, a cell in the central area has two interconnects on one side thereof and a single interconnect on the other side thereof, and a cell in each of the left and right ends has two interconnects on each side thereof. Such a layout difference will appear as a noise difference, for example, tending to cause a variation between currents supplied to the cells.

The second problem is that the currents supplied by the cells have their accuracy lowered because no full consideration is given to attempts to suppress the effect of noise. If parasitic capacitances such as a capacitance between adjacent interconnects and a capacitance between interconnect layers are not sufficiently taken into account, then when a signal is transmitted to an interconnect, the effect of the noise appears as noise in another interconnect or a capacitor, tending to lower the accuracy of the current supplied from the cell.

SUMMARY OF THE INVENTION

It is an object of the present invention to provide a semiconductor device having, on a principal surface of a substrate, a plurality of functional blocks each having a function to hold either a voltage determined by a current supplied from a current source or a voltage supplied from a voltage source and to supply a current or a voltage determined by the voltage thus held to an external circuit, and also to provide to a semiconductor device having a layout suitable for use as a driver for a display apparatus, for providing a current or a voltage with high accuracy while suppressing variations between functional blocks in a current or a voltage supplied to an external circuit, and a display apparatus employing such a semiconductor device.

The present invention is applied to a semiconductor device comprising, on a principal surface of a substrate, a plurality of functional blocks each having a function to hold either a voltage determined by a current supplied from a current source or a voltage supplied from a voltage source and to supply a current or a voltage determined by the voltage thus held to an external circuit. To achieve the above object, the semiconductor device has a plurality of unit areas each having one of the functional blocks, supply interconnects for supplying the current supplied from the current source or the voltage supplied from the voltage source to the functional block, and signal interconnects for propagating a signal other than the current supplied from the current source or the voltage supplied from the voltage source, the unit areas being arranged in at least one direction on the principal surface. The signal interconnects including identical numbers of interconnects being disposed respectively on left and right sides of the functional block and extending in the one direction over the unit areas.

Preferably, the functional blocks and the signal interconnects in the unit areas are arranged in the same shape and the same layout in the unit areas.

To achieve the above object, there is also provided a display apparatus having the above semiconductor device as a driver for a display unit.

With the semiconductor device according to the present invention, the unit areas including the respective functional blocks are arranged in at least one direction on the principal surface, and the functional blocks and the interconnects in the unit areas are arranged in the same shape and the same layout in the unit areas. Therefore, even if the semiconductor device is fabricated by a manufacturing process which is directional, the semiconductor device is not affected by the manufacturing process, and not affected by layout differences between interconnects connected the functional blocks. Therefore, voltages held by the functional blocks are prevented from varying, and the accuracy of currents or voltages supplied from the functional blocks to an external circuit is increased.

Furthermore, a component for holding a voltage is surrounded by an interconnect that is maintained at a constant potential. This arrangement is effective to shield the effect that a signal transmitted through an interconnect adjacent to the component has on the component, thereby suppressing variations of the voltage held by the component and increasing the accuracy of a supplied current or voltage corresponding to the voltage thus held.

Moreover, interconnects that are maintained at a constant potential are inserted between interconnects for supplying currents or voltages to the functional blocks and interconnects adjacent to those interconnects for transmitting signals that change with time. Consequently, the effect that the signals that change with time has on the currents or voltages supplied to the functional blocks is shielded, thus suppressing variations of the currents or voltages supplied to the functional blocks. Consequently, the accuracy of voltages that are held which correspond to the currents or voltages supplied to the functional blocks is increased, and hence the accuracy of currents or voltages to be supplied to an external circuit which correspond to the voltages that are held is increased.

The above and other objects, features, and advantages of the present invention will become apparent from the following description with reference to the accompanying drawings which illustrate examples of the present invention.

DETAILED DESCRIPTION OF THE PREFERRED EMBODIMENTS

Figure 4:
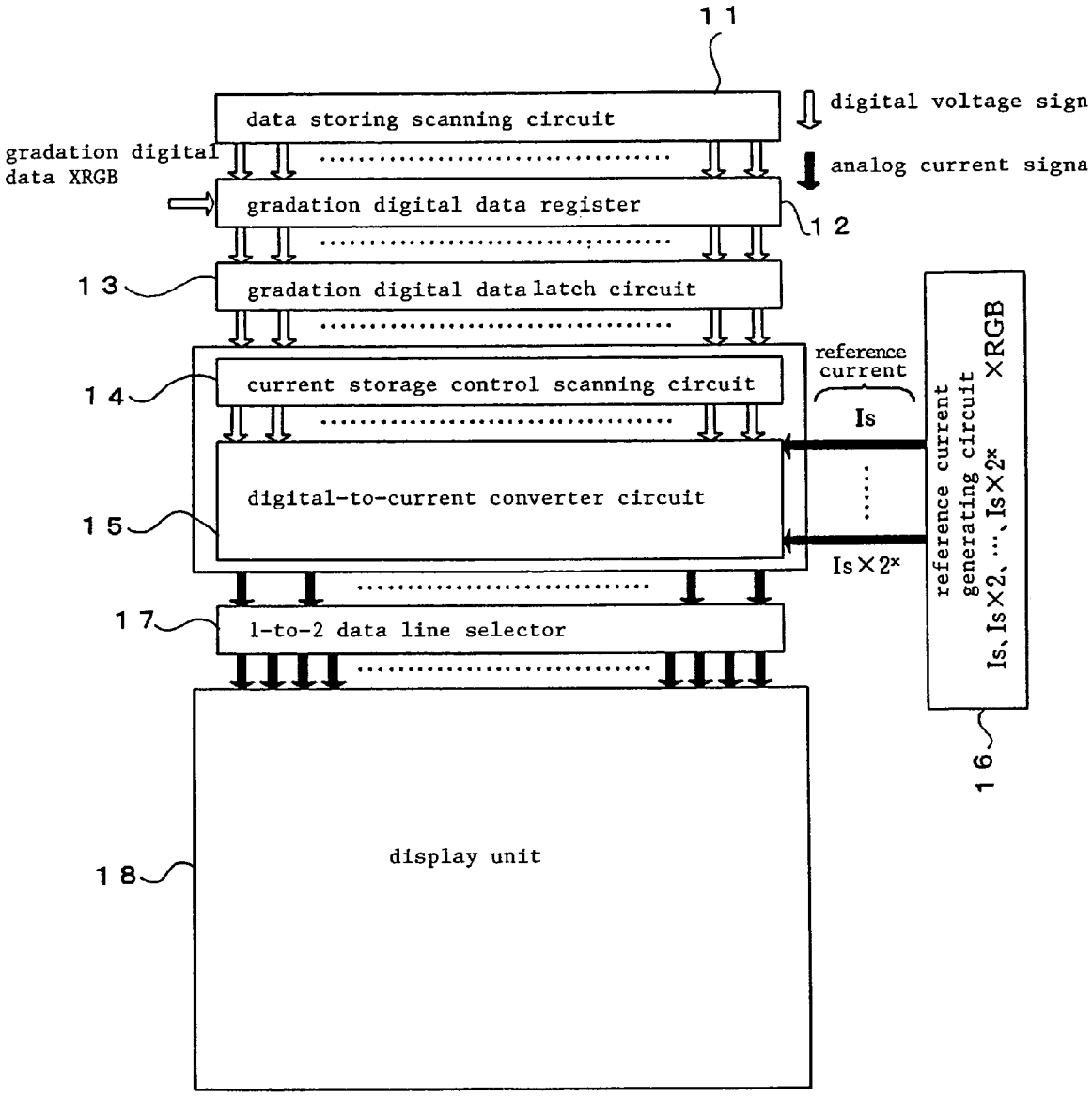
FIG. 4 is a block diagram of a display apparatus which employs a semiconductor device according to the present invention as a driving device.

FIG. 4 shows in block form a display apparatus which employs a semiconductor device according to the present invention as a driving device. As shown in FIG. 4, the display apparatus comprises data storing scanning circuit 11, gradation digital data register 12, gradation digital data latch circuit 13, current storage control scanning circuit 14, digital-to-current converter circuit (hereinafter referred to as "DCC circuit") 15, reference current generating circuit 16, 1-to-2 data line selector 17, and display unit 18, which are all mounted on a single board. The semiconductor device according to the present invention incorporates at least DCC circuit 15, exclusive of display unit 18.

Display unit 18 has a plurality of data lines extending from 1-to-2 data line selector 17 and a plurality of scanning lines extending from a vertical scanning circuit (not shown) across the data lines. Sub pixels including OLED elements are disposed at respective points of intersection between the data lines and the scanning lines. Each scanning line has N pixels each comprising an R sub pixel, a G sub pixel, and a B sub pixel. Therefore, display unit 18 has 3N data lines.

1-to-2 data line selector 17 serves to connect each of the output terminals of DCC circuit 15 to one of two corresponding data lines. However, since 1-to-2 data line selector 17 is not indispensable in the display unit, the display apparatus will be described below on the assumption that it is devoid of 1-to-2 data line selector 17, and the function of 1-to-2 data line selector 17 will finally be described.

Figure 5:
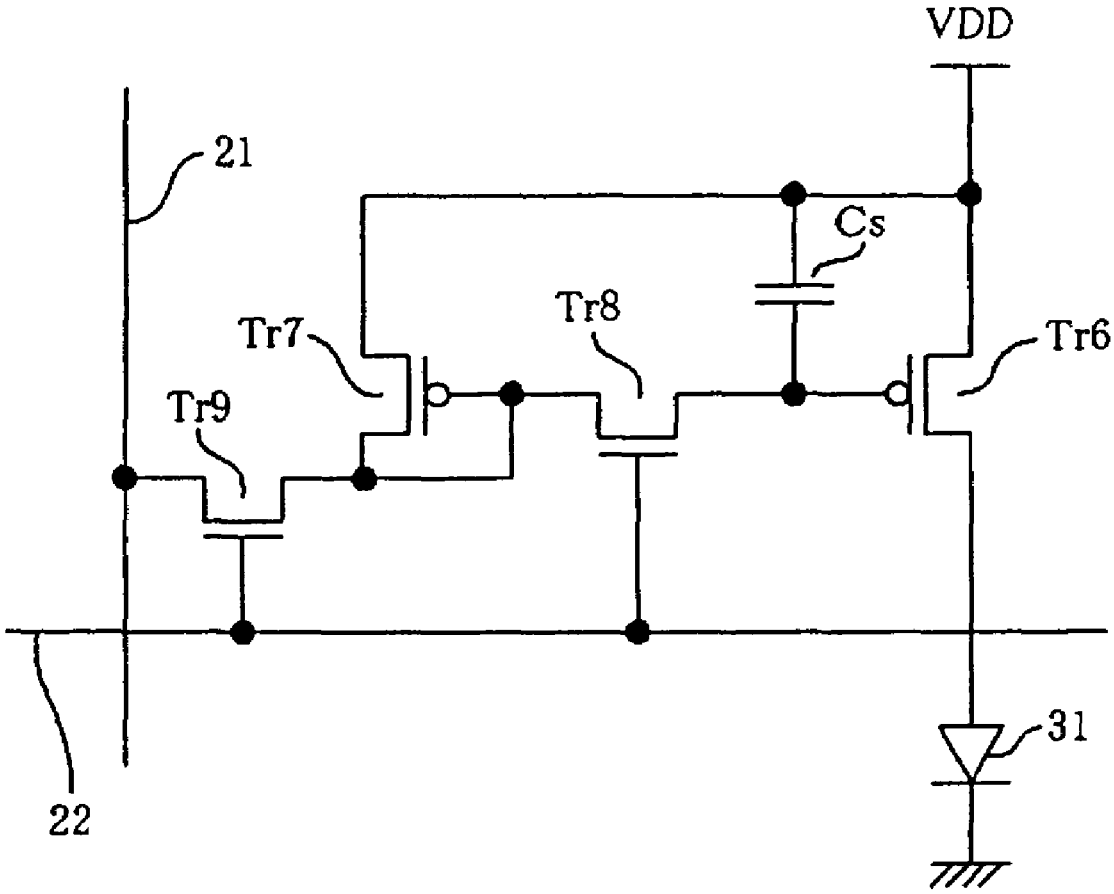
FIG. 5 is a circuit diagram of a sub pixel in a display unit shown in FIG. 4.

FIG. 5 shows in block form either one of the R sub pixel, the G sub pixel, and the B sub pixel in display unit 18. Transistor Tr9 in the form of an N-channel FET has a gate connected to scanning line 22, a drain connected to data line 21, and a source connected to the drain and gate of transistor Tr7 in the form of a P-channel FET. Transistor Tr8 in the form of an N-channel FET has a gate connected to scanning line 22, a drain connected to the drain and gate of transistor Tr7, and a source connected to the gate of transistor Tr6 in the form of a P-channel FET and a terminal of holding capacitor Cs. The sources of transistors Tr6, Tr7 and the other terminal of holding capacitor Cs are supplied with power supply potential VDD. OLED element 31 is forward-connected between the drain of transistor Tr6 and the ground potential.

When the vertical scanning circuit selects scanning line 22, turning on transistors Tr8, Tr9, DCC circuit 15 supplies a sink current to data line 21. The current flows between the drain and source of transistor Tr7, thus determining a gate-to-source voltage of transistor Tr7. Since the drain and gate of transistor Tr7 are short-circuited, it operates in its saturated state. If transistor Tr7 and transistor Tr6 have equal current capabilities, i.e., if their carrier mobilities, gate capacitances per unit area, threshold voltages, and channel width-to-length ratios are equal, then transistors Tr7, Tr6 provide a current mirror. Therefore, a forward current which is equal to the current supplied from DCC circuit 15 flows through transistor Tr6 into OLED element 31, enabling OLED element 31 to emit light at an intensity depending on the current.

When the selection of scanning line 22 is canceled, since holding capacitor Cs is holding the voltage that was applied while scanning line 22 was being selected, the current keeps flowing into OLED element 31, which continuously emits light. The above process is performed simultaneously in all sub pixels on one scanning line, and repeated on all the scanning lines to display information on display unit 18. If the current capability of transistor Tr6 is $\alpha$ times the current capability of transistor Tr7, then a forward current which is $\alpha$ times the current supplied from DCC circuit 15 flows into OLED element 31.

Data storing scanning circuit 11 shown in FIG. 4 generates a start signal and a clock signal or is supplied with a start signal and a clock signal from an external circuit. Using the start signal and the clock signal, data storing scanning circuit 11 outputs a reading signal, which determines the timing to read gradation digital data supplied from an external circuit into gradation digital data register 12, to gradation digital data register 12. In response to the reading signal, gradation digital data register 12 successively reads and stores (x+1)-bit gradation digital data that are successively sent from the external circuit. When one scanning line of gradation digital data is stored in gradation digital data register 12, gradation digital data latch circuit 13 latches and outputs that one scanning line of gradation digital data to DCC circuit 15.

Reference current generating circuit 16 generates reference currents (gradation analog currents) IS, ISx2, . . . , ISx2×(IS=IR, IG, IB). IR, IG, IB represent currents equal or proportional to currents that flow into the OLED elements to enable them to emit light in red, green, and blue with the first gradation, IRx2, IGx2, IBx2 represent currents equal or proportional to currents that flow into the OLED elements to enable them to emit light in red, green, and blue with the second gradation, and IRx2×, IGx2×, IBx2× represent currents equal or proportional to currents that flow into the OLED elements to enable them to emit light in red, green, and blue with the 2×th gradation. Voltages corresponding to these currents are stored in a functional block in DCC circuit 15 in synchronism with output signals from current storage control scanning circuit 14. DCC circuit 15 supplies gradation analog currents corresponding to the gradation digital data input from gradation digital data latch circuit 13, from the functional block to the data lines of display unit 18.

Figure 6:
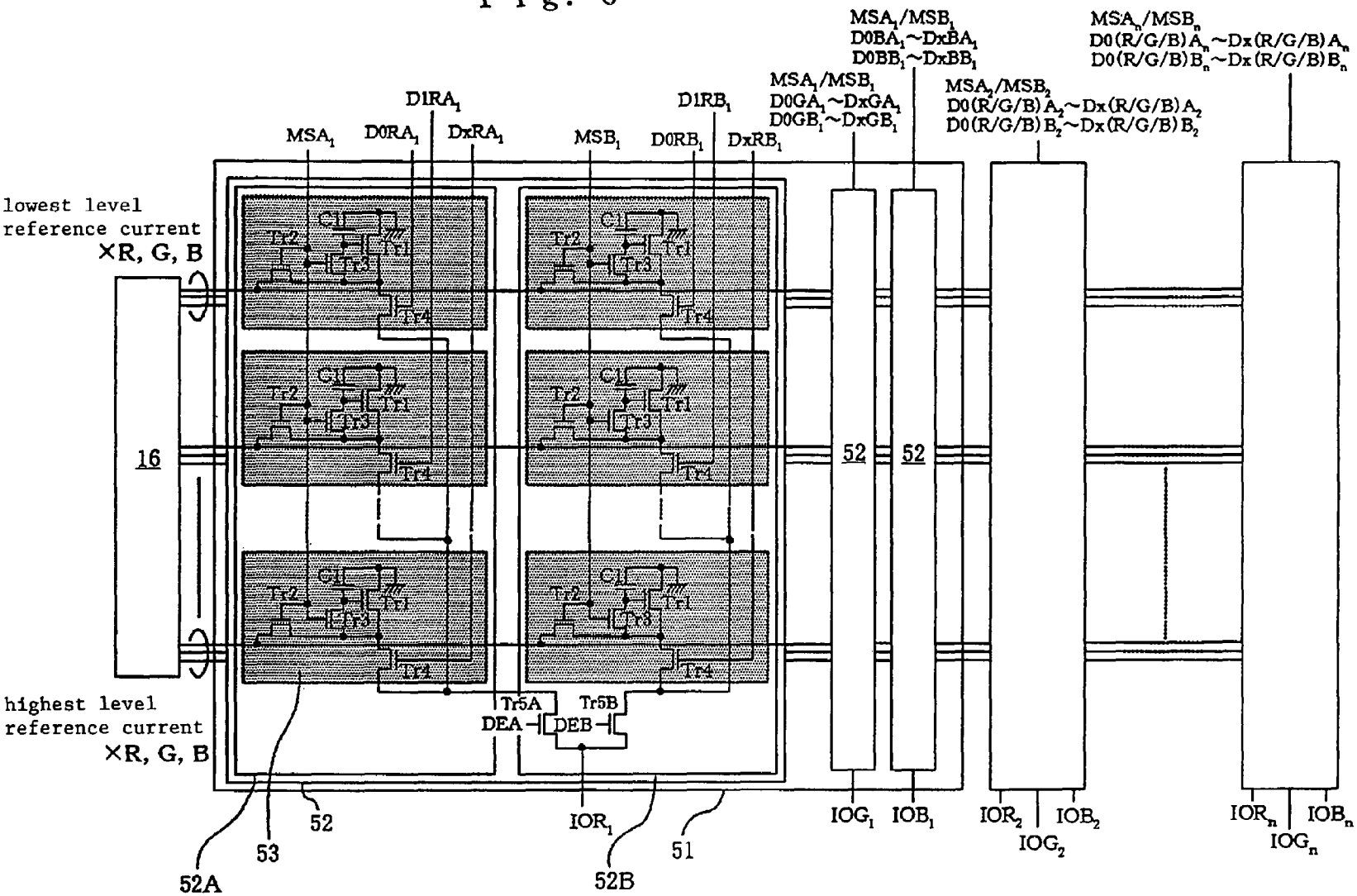
FIG. 6 is a block diagram of a digital-to-current converter circuit shown in FIG. 4.

FIG. 6 shows in block form DCC circuit 15 illustrated in FIG. 4. DCC circuit 15 has n DCC circuit blocks 51. Each of DCC circuit blocks 51 has three (x+1)-bit DCC circuit pairs 52 corresponding to an R sub pixel, a G sub pixel, and a B sub pixel in display unit 18. Each of (x+1)-bit DCC circuit pairs 52 comprises (x+1)-bit DCC circuit (A) 52A and (x+1)-bit DCC circuit (B) 52B. Each of (x+1)-bit DCC circuit (A) 52A and (x+1)-bit DCC circuit (B) 52B comprises (x+1) 1-bit DCC circuits 53. Each of (x+1) 1-bit DCC circuits 53 comprises four transistors Tr1 through Tr4 in the form of N-channel FETs and holding capacitor C, and serves as a minimum functional block.

Transistor Tr2 has a source connected to the drains of transistors Tr1, Tr3, Tr4. Transistor Tr3 has a source connected to the gate of transistor Tr1 and a terminal of holding capacitor C. The source of transistor Tr1 and the other terminal of holding capacitor C are connected to ground. Transistor Tr2 has a drain supplied with either one of reference currents IS, ISx2, . . . , ISx2× from reference current generating circuit 16. Specifically, the drains of transistors Tr2 of (x+1) 1-bit DCC circuits 53 are supplied with respective (x+1) gradation analog currents from reference current generating circuit 16. The gates of transistors Tr2, Tr3 of (x+1)-bit DCC circuits (A) 52A and (x+1)-bit DCC circuits (B) 52B of the 1 st through nth DCC circuit blocks are supplied with respective output signals (hereinafter referred to as "storage timing signals") MSA1 through MSAn, MSB1 through MSBn from current storage control scanning circuit 14. Data enable signals DEA, DEB that are reversed in every frame are applied mutually exclusively to transistors Tr5A, Tr5B of cell switcher 55.

Figure 7:
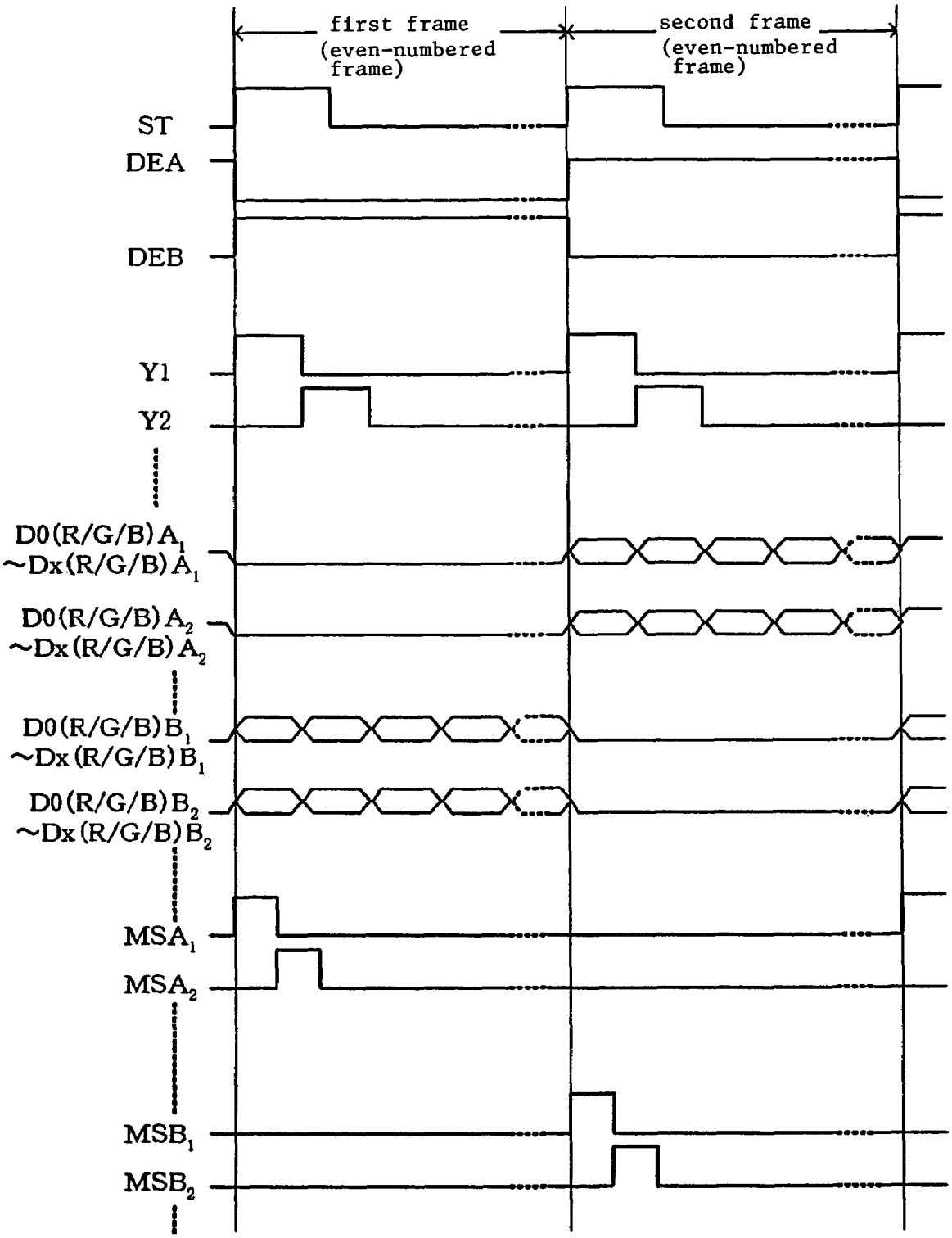
FIG. 7 is a timing chart which is illustrative of operation of the digital-to-current converter circuit shown in FIG. 4.

FIG. 7 is a timing chart which is illustrative of operation of the DCC circuit shown in FIG. 6. In a first frame which is an odd-numbered frame, data enable signal DEA is of a low level and data enable signal DEB is of a high level. When start signal ST from data storing scanning circuit 11 goes high, the storage timing signal MSA1 that is supplied to the gates of transistors Tr2, Tr3 of (x+1) 1-bit DCC circuits 53 of three (x+1)-bit DCC circuits (A) 52A, which correspond to the R sub pixel, the G sub pixel, and the B sub pixel in display unit 18, in first DCC block 51, goes high. Transistors Tr2, Tr3 are thus turned on, allowing the reference current supplied from reference current generating circuit 16 to transistor Tr2 of each 1-bit DCC circuit 53 to flow through channels formed between the drains and sources of transistors Tr2, Tr3 into transistor Tr1 and holding capacitor C. At this time, since the gate and drain of transistor Tr1 are short-circuited, it operates in its saturated state. In a stable state, the voltage between the gate and source of transistor Tr1, i.e., the voltage across holding capacitor C, is determined according to the current capability of transistor Tr1 so that the reference current flows between the source and drain of transistor Tr1. After the stable state is reached, storage timing signal MSA1 goes low. The voltage before storage timing signal MSA1 goes low is held between the gate and source of transistor Tr1, i.e., the voltage across holding capacitor C. Then, the storage timing signal MSA2 that is supplied to the gates of transistors Tr2, Tr3 of (x+1) 1-bit DCC circuits 53 of three (x+1)-bit DCC circuits (A) 52A in second DCC block 51, goes high, and the above process is repeated. As the reference current flows between the drain and gate of transistor Tr1, the voltage between the gate and source of transistor Tr1, i.e., the voltage across holding capacitor C, is determined according to the current capability of transistor Tr1.

Subsequently, storage timing signals MSA3 through MSAn that are supplied to the gates of transistors Tr2, Tr3 of (x+1) 1-bit DCC circuits 53 of three (x+1)-bit DCC circuits (A) 52A in third through nth DCC blocks 51, go high, and the above process is repeated, determining the gate-to-source voltages of all transistors Tr1 thereof, i.e., the voltages across holding capacitors C thereof. In this manner, voltages corresponding to reference currents are stored in transistors Tr1 of all (x+1)-bit DCC circuits (A) 52A in first through nth DCC blocks 51 during one frame.

Voltages corresponding to reference currents are stored in transistors Tr1 of all (x+1)-bit DCC circuits (B) 52B in first through nth DCC blocks 51 during the preceding frame according to the same process as the process described above. All storage timing signals MSA1 through MSAn are of a low level throughout this odd-numbered frame. When the first scanning line in display unit 18 is selected, i.e., when scanning line voltage Y1 goes high, in this state, gradation digital data corresponding to the intensities of light to be emitted from the OLED elements of the sub pixels on the scanning line are input from gradation digital data latch circuit 13 to (x+1)-bit DCC circuits (B) 52B that are connected to the data lines of the sub pixels. For example, gradation digital data D0RB1 through DxRB1 corresponding to the intensities of light to be emitted from the OLED elements of the R sub pixel of the first pixel on the selected scanning line are input to the gates of respective transistors Tr4 of (x+1) 1-bit DCC circuits 53 of (x+1)-bit DCC circuit (B) 52B which corresponds to the R sub pixel of first DCC circuit block 51. At this time, lowest level, second lowest level, . . . . highest level gradation digital data D0RB1, D1RB1, . . . , DxRB1 are input respectively to the gates of transistors Tr4 of 1-bit DCC circuits 53 that are supplied with lowest level reference current IR, second lowest level reference current IRx2, . . . , highest level reference current IRx2×, respectively.

Those transistors Tr4 to which gradation digital data having a value "1" of those gradation digital data D0RB1, D1RB1, . . . , DxRB1 is applied are turned on, outputting gradation analog currents corresponding to the voltages stored in transistors Tr1. As shown in FIG. 6, the sum of those output gradation analog currents is supplied as desired current IOR1 to the corresponding gate line.

At the same time, gradation digital data D0GB1 through DxGB1, D0BB1 through DxBB1 are input to the gates of respective transistors Tr4 of (x+1) 1-bit DCC circuits 53 of (x+1)-bit DCC circuits (B) 52B which correspond to the R and B sub pixels, supplying desired currents IOG1, IOB1 to the corresponding gate lines. The above process is carried out simultaneously in all the DCC circuit blocks, supplying desired currents IOR1, IOG1, IOB1, IOR2, IOG2, IOB2, . . . , IORn, IOGn, IOBn to the corresponding gate lines depending on gradation digital data D0(R/G/B)B1 through Dx(R/G/B)B1, D0(R/G/B)B2 through Dx(R/G/B)B2, . . . , D0(R/G/B)Bn through Dx(R/G/B)Bn.

According to the above process, all the sub pixels on the first scanning line simultaneously emit light at desired intensities. Then, the second scanning line is selected (scanning voltage Y2 goes high), and the above process is repeated.

The scanning lines are vertically successively scanned, and the above process is repeated each time a scanning line is selected, displaying one frame of information on display unit 18. In a second frame which is an even-numbered frame, data enable signal DEA is of a high level and data enable signal DEB is of a low level, and (x+1)-bit DCC circuits (A) 52A and (x+1)-bit DCC circuits (B) 52B switch their operation around.

By repeating the above operation, during the odd-numbered frame, (x+1)-bit DCC circuits (A) 52A hold voltages corresponding to reference currents from reference current generating circuit 16, (x+1)-bit DCC circuits (B) 52B supply analog gradation currents to the sub pixels of display unit 18, and during the even-numbered frame, (x+1)-bit DCC circuits (A) 52A and (x+1)-bit DCC circuits (B) 52B switch their operation around. In this manner, it is possible to switch around the operation of (x+1)-bit DCC circuits (A) 52A and the operation of (x+1)-bit DCC circuits (B) 52B in every frame.

Transistors Tr2, Tr3 operate to switch on and off the supply of the reference current to the 1-bit DCC circuit in synchronism with the storage timing signal, and transistor Tr4 operates to switch on and off the supply of the current from the 1-bit DCC circuit in synchronism with the gradation digital data. Therefore, these transistors may be replaced with any desired switching elements.

Figure 1:
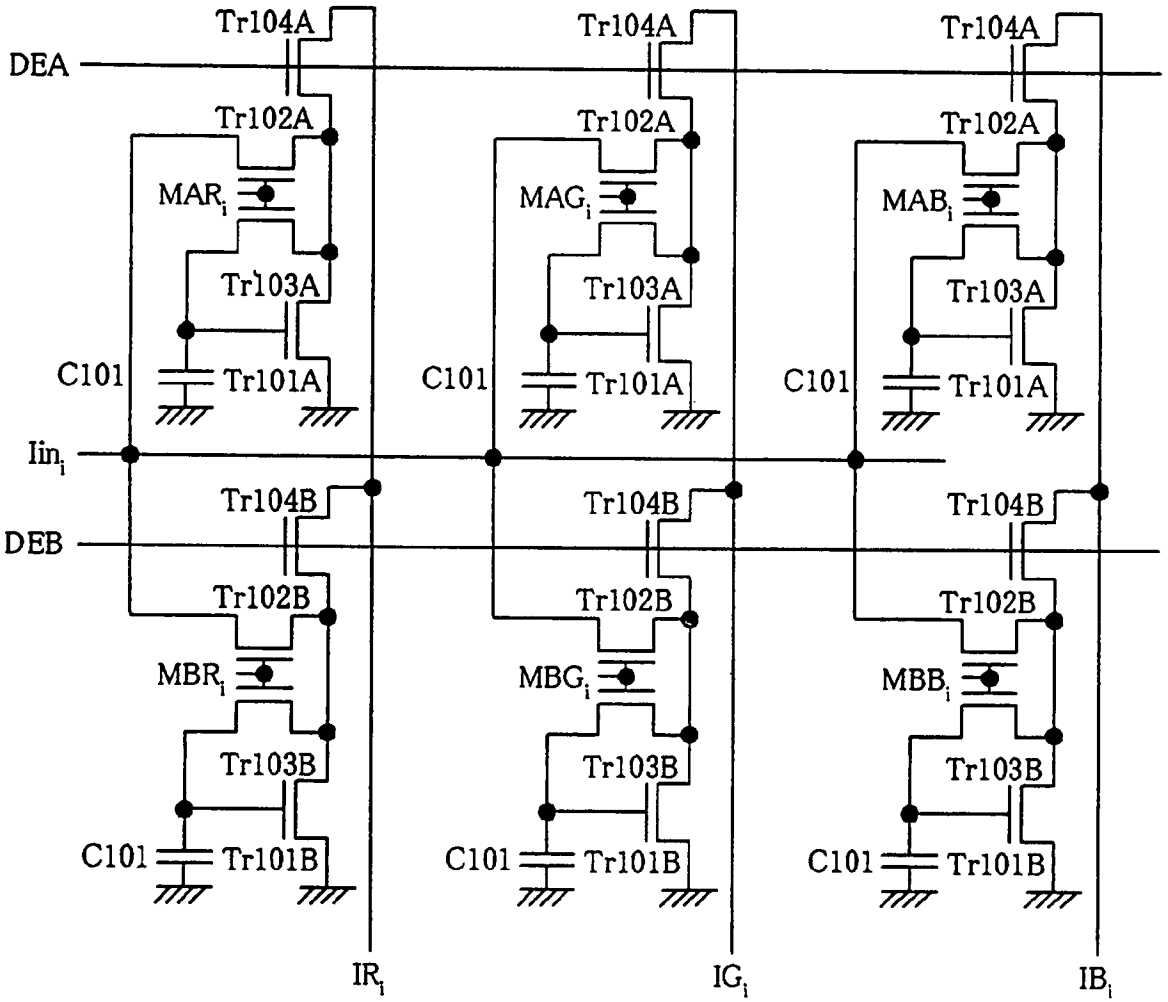
Fig. 1 PRIOR ART
FIG. 1 is a circuit diagram of a circuit block of a semiconductor device as a conventional current-program-type data line driver.
Figure 2:
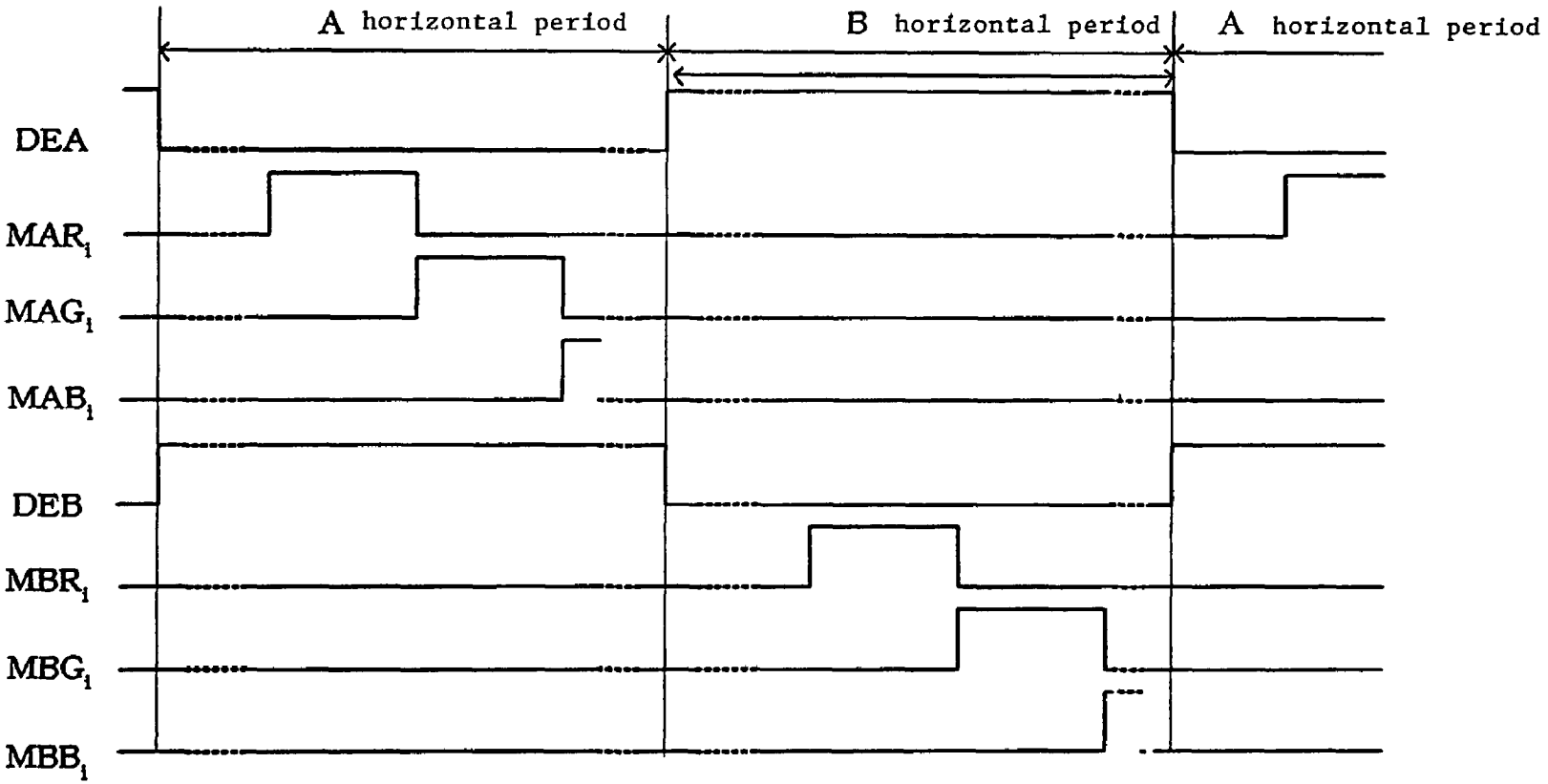
Fig. 2 PRIOR ART
FIG. 2 is a timing chart which is illustrative of operation of the circuit clock shown in FIG. 1.
Figure 3:
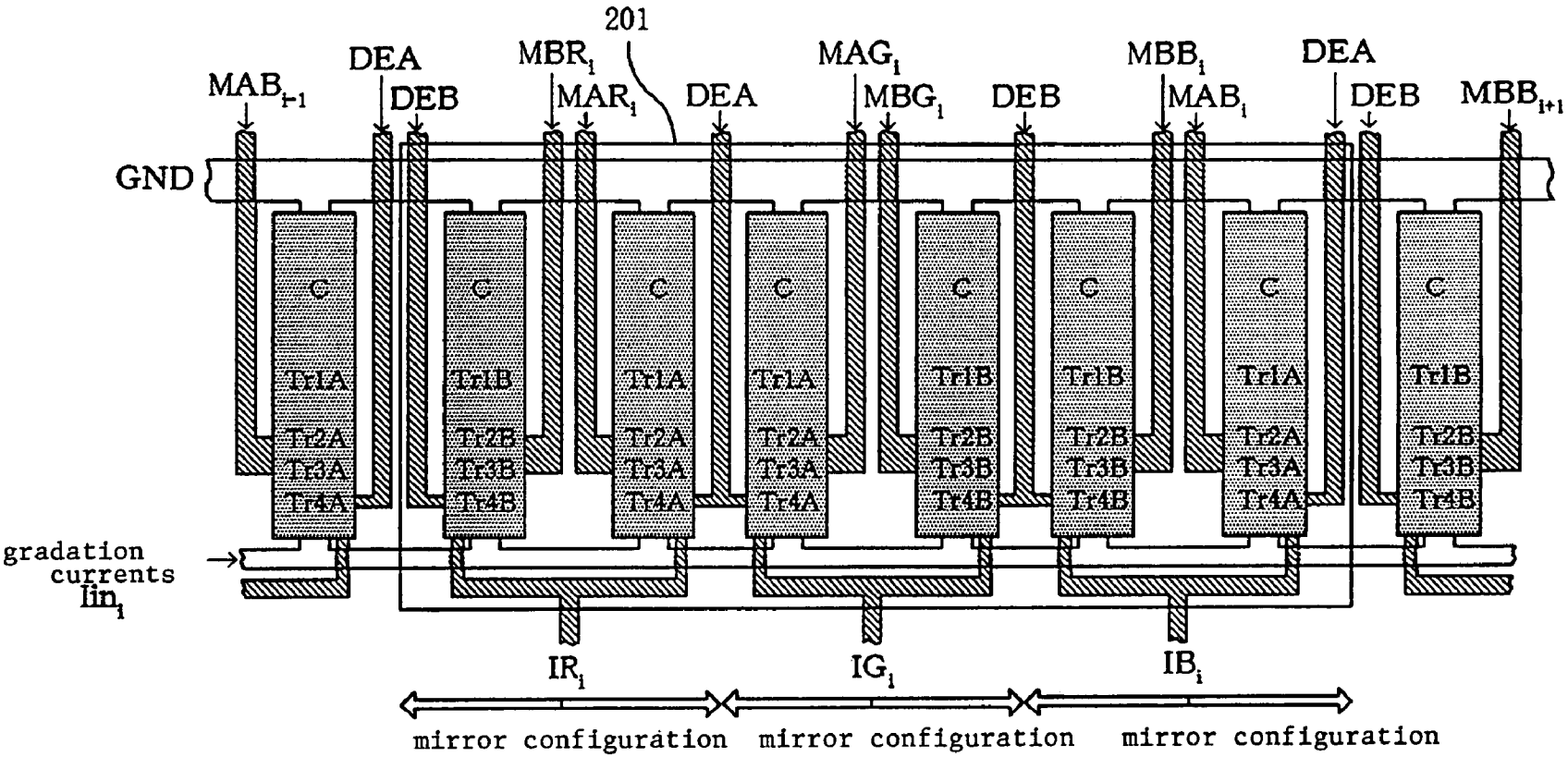
Fig. 3 PRIOR ART
FIG. 3 is a view showing a conventionally designed layout of the circuit block shown in FIG. 1.

The function of 1-to-2 data line selector 17 will be described below. As described above, voltages are held in three (x+1)-bit DCC circuits (A) or (B) corresponding to the R sub pixel, the G sub pixel, and the B sub pixel in display unit 18, simultaneously as one set. In the circuit block of the current-program-type data line driver described in the related art, however, voltages are successively held in three cells A or B corresponding to the R sub pixel, the G sub pixel, and the B sub pixel in display unit, as shown in FIG. 2. Therefore, if the number of pixels is equal, then the DCC circuit according to the present invention can hold voltages in a period of time which is ½ through ⅓ of the period of time taken by the circuit block of the current-program-type data line driver.

With the DCC circuit according to the present invention, if the number of pixels on one horizontal line is twice the number of pixels of the conventional displays and each of the number of R sub pixels, the number of G sub pixels, and the number of B sub pixels on one scanning line is N, then the DCC circuit has n=N/2 DCC circuit blocks, and three outputs, which correspond to the R sub pixel, the G sub pixel, and the B sub pixel in display unit, from three (x+1)-bit DCC circuits (A) or (B) of each of the DCC circuit blocks are switched chronologically per pixel and supplied to six data lines connected to the R sub pixels, the G sub pixels, and the B sub pixels of two pixels in the display unit, thereby displaying information on all the pixels within one frame. This switching operation is performed by 1-to-2 data line selector 17.

Figure 8:
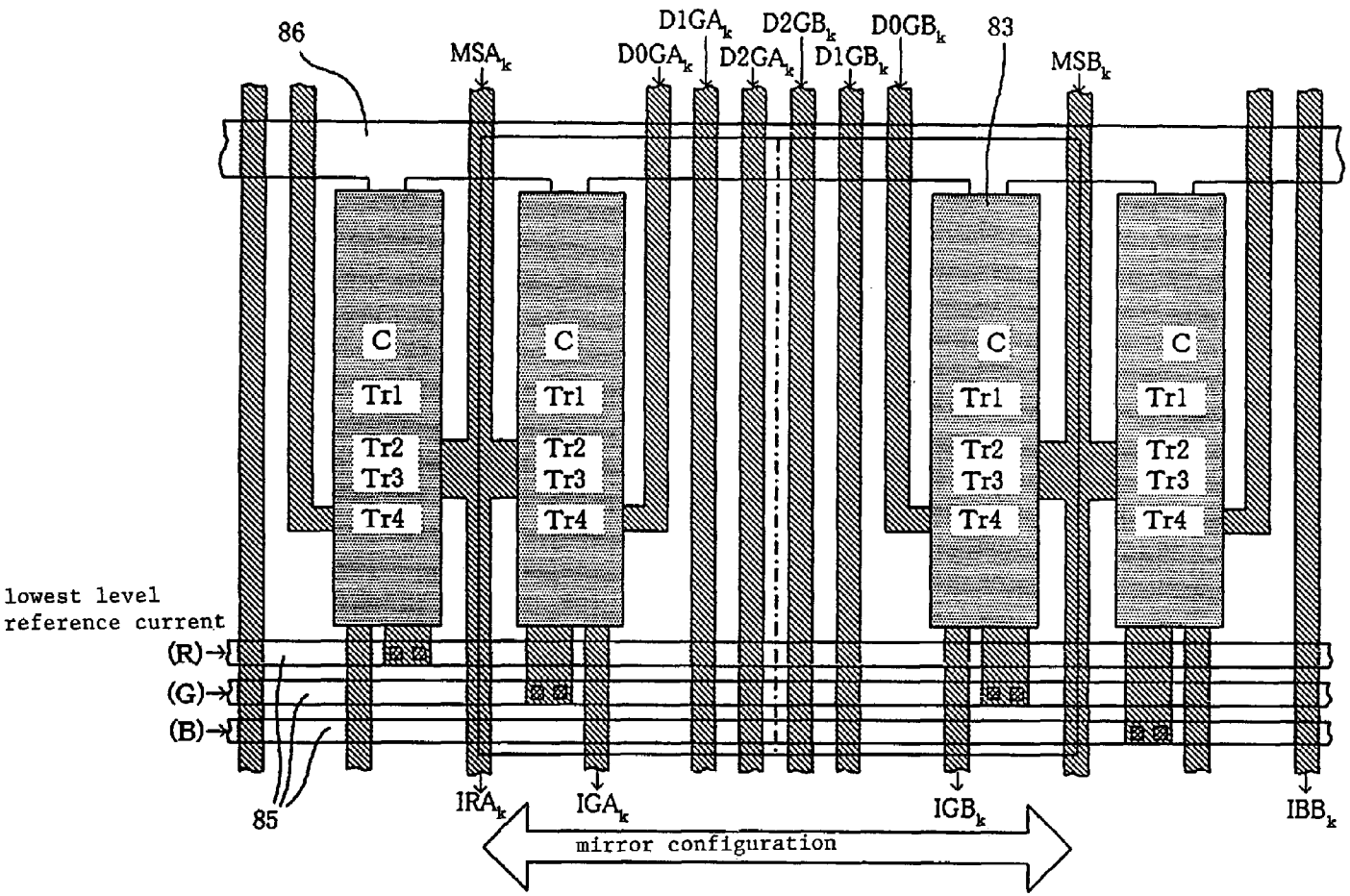
FIG. 8 is a view showing a conventionally designed layout of the digital-to-current converter circuit shown in FIG. 4.

FIG. 8 shows a conventionally designed mirror layout of the 1-bit DCC circuit of kth (k is a positive integer of n or smaller) DCC circuit block 51, which is supplied with the lowest level reference current from reference current generating circuit 16. In FIG. 8, for the sake of brevity, the (x+1) bits are 3 bits, and only a 1-bit DCC circuit (output current: IRAk) of 3-bit DCC circuit (A) corresponding to the R sub pixel, 1-bit DCC circuits (output currents: IGAk, IGBk) of 3-bit DCC circuits (A), (B) corresponding to the G sub pixel, and a 1-bit DCC circuit (output current: IBBk) of 3-bit DCC circuit (B) corresponding to the B sub pixel in DCC circuit block 51 are illustrated.

As shown in FIG. 8, interconnects for supplying gradation digital data (D0GAk through D2GAk, D0BAk through D2BAk) to 1-bit DCC circuits, interconnects for supplying storage timing signals (MSAk, MSBk in FIG. 8), and interconnects for supplying output currents (IRAk, IGAk, IGBk, IBBk) to sub pixels are formed as a first interconnect layer in a first plane parallel to the surface of the substrate. Reference current interconnects 85 for supplying reference currents and GND interconnect 86 are formed as a second interconnect layer in a second plane which is positioned above the first plane with an interlayer insulating film interposed therebetween. 1-bit DCC circuit regions 83 with 1-bit DCC circuits formed therein are present in a lowermost area on the substrate.

As shown in FIG. 8, the 1-bit DCC circuit regions of 3-bit DCC circuits (A), (B) and interconnects disposed therearound are arranged in a mirror configuration with identical intervals between the interconnects, except that different gradation digital data are input thereto. The components in the 1-bit DCC circuits are also arranged in identical layouts.

With these arrangements, variations and errors due to layout differences are reduced for increased operational accuracy. Furthermore, adjacent 1-bit DCC circuits connected to different data lines can share storage timing signals (MSAk, MSBk).

For example, in FIG. 8, the 1-bit DCC circuit region for the R sub pixel in 3-bit DCC circuit (A) and the 1-bit DCC circuit region for the G sub pixel in 3-bit DCC circuit (A) share the storage timing signal MSAk, and the 1-bit DCC circuit region for the G sub pixel in 3-bit DCC circuit (B) and the 1-bit DCC circuit region for the B sub pixel in 3-bit DCC circuit (B) share the storage timing signal MSBk. Therefore, three 3-bit DCC circuit pairs in one DCC circuit block require four storage timing signals per reference current, resulting in a reduced layout area, although they require six storage timing signals per reference current if they are not arranged in a mirror configuration.

With the above layout, however, the problems to be solved by the present invention still remain to be solved. The problems can be solved by the following embodiments. According to the present invention, there is provided a layout capable of suppressing variations in a current or a voltage supplied from each functional block to provide a current or a voltage highly accurately in a semiconductor device which has, on a principal surface of a substrate, a plurality of functional blocks each having a function to hold either a voltage determined by a current supplied from a current source or a voltage supplied from a voltage source and to supply a current or a voltage determined by the voltage thus held to an external circuit.

In the description which follows, a storage timing signal, gradation digital data, and an output current will be expressed as storage timing signal MSk, gradation digital data D0k, D1k, D2k, and output current IOk, for example, rather than being distinguished with respect to (x+1)-bit DCC circuits (A), (B) and the R sub pixel, the G sub pixel, and the B sub pixel.

1st Embodiment

Figure 9:
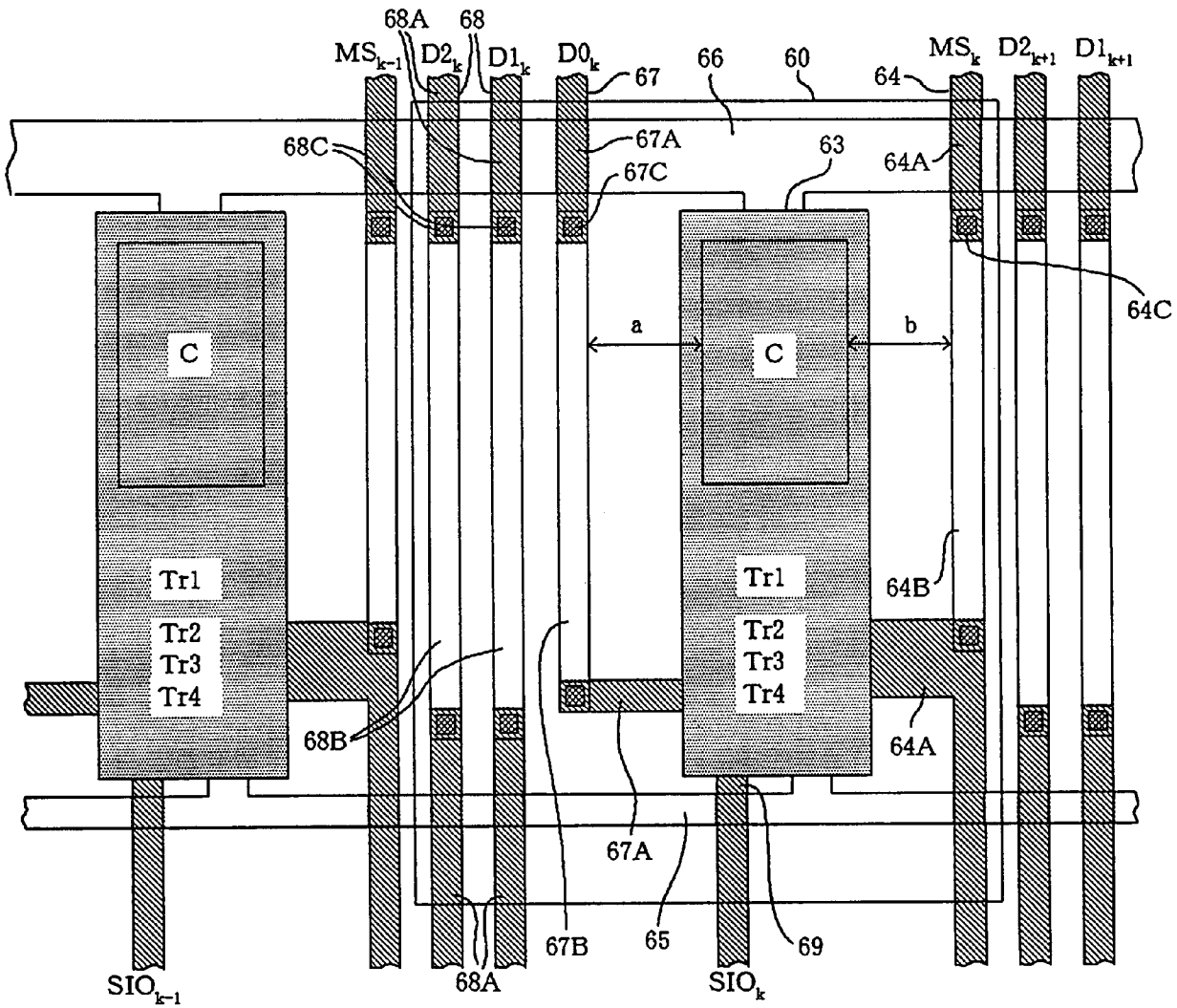
FIG. 9 is view showing the layout of a unit area of a semiconductor device according to a first embodiment of the present invention.

FIG. 9 is view showing the layout of a unit area of a semiconductor device according to a first embodiment of the present invention. As shown in FIG. 9, the semiconductor device according to the first embodiment has, in unit area 60 thereof, 1-bit DCC circuit region 63 comprising single 1-bit DCC circuit 53 shown in FIG. 6. FIG. 9 shows the unit area having a region where 1-bit DCC circuit 53 supplied with the lowest level reference current and the lowest level gradation digital data in kth DCC circuit block 51 shown in FIG. 6 is formed. Unit areas including other 1-bit DCC circuit regions are of an identical arrangement. Though (x+1) bits are 3 bits for the sake of brevity in FIG. 9, (x+1) bits are not limited to 3 bits/

1-bit DCC circuit region 63 comprises transistors Tr1, Tr2, Tr3, Tr4 and holding capacitor C shown in FIG. 6. To the gates of transistors Tr2, Tr3, there is connected storage timing signal interconnect 64 that is supplied with storage timing signal MSk from the current storage control circuit. Reference current interconnect 65 that is supplied with a reference current (lowest level reference current in FIG. 9) from the reference current generating circuit is connected to the drain of transistor Tr2. GND interconnect 66 is connected to the source of transistor Tr1 and one terminal of holding capacitor C.

Gradation digital data interconnect 67 that is supplied with gradation digital data (lowest level gradation digital data D0k in FIG. 9) and 1-bit current output interconnect 69 for outputting current SIOk per 1-bit DCC circuit are connected respectively to the gate and source of transistor Tr4. Unit area 60 also includes gradation digital data interconnect 68 for supplying other gradation digital data (second lowest level gradation digital data D1k and highest level gradation digital data D2k in FIG. 9) to other unit areas.

On the left and right of the unit area having the 1-bit DCC circuit region that belongs to the kth DCC circuit block, there are disposed a unit area having a 1-bit DCC circuit region that belongs to a (k−1)th DCC circuit block and a unit area having a 1-bit DCC circuit region that belongs to a (k+1)th DCC circuit block.

The semiconductor device shown in FIG. 9 is fabricated on a glass substrate, and includes a highly doped N-type poly-Si (polycrystalline Silicon) layer and an active layer of an N-channel transistor of the 1-bit DCC circuit within 1-bit DCC circuit region 63, as a lowermost layer on the glass substrate or with a base layer in the form of a silicon nitride film interposed between them and the glass substrate. Highly doped N-type poly-Si layers are also disposed on both sides of the active layer, making up a drain electrode and a source electrode. A first interconnect layer is disposed above those layers with a first interlayer insulating film interposed therebetween.

The first interconnect layer is provided chiefly for forming storage timing signal interconnect 64 and gradation digital data interconnects 67, 68, i.e., for forming interconnects connected to the gates of N-channel transistors, and is also used to form 1-bit current output interconnect 69. The first interlayer insulating film between the active layer of the lowermost layer and the first interconnect layer on the active layer of the lowermost layer comprises a gate insulating film.

The first interconnect layer is also disposed directly above the highly doped N-type poly-Si layer, which is not the drain electrode and the source electrode, of the lowermost layer. The highly doped N-type poly-Si layer,.the first interconnect layer, and the first interlayer insulating film therebetween jointly make up holding capacitor C. Although holding capacitor C can be made up of the first interconnect layer, the second interconnect layer, and a second interlayer insulating film, since the first interlayer insulating film is thinner than the second interlayer insulating film, the former makeup of holding capacitor C is more advantageous for a higher capacitance value with a smaller area. If P-channel transistors are used in the 1-bit DCC circuit, then P-channel transistors are also provided in the 1-bit DCC circuit region.

Reference current interconnect 65 and GND interconnect 66 are provided by the second interconnect layer. Storage timing signal interconnect 64 and gradation digital data interconnects 67, 68 are provided by the first interconnect layer in their portions extending below reference current interconnect 65 and GND interconnect 66 and their portions connected to the gates of transistors in 1-bit DCC circuit region 63. In areas adjacent to holding capacitor C, storage timing signal interconnect 64 and gradation digital data interconnects 67, 68 are provided by the second interconnect layer which is an interconnect layer not used as the electrodes of holding capacitor C.

The portions of storage timing signal interconnect 64 and gradation digital data interconnects 67, 68 which are provided by the first interconnect layer will hereinafter be referred to as storage timing signal interconnect layer 64A and gradation digital data interconnect layers 67A, 68A, and the portions of storage timing signal interconnect 64 and gradation digital data interconnects 67, 68 which are provided by the second interconnect layer will hereinafter be referred to as storage timing signal interconnect layer 64B and gradation digital data interconnect layers 67B, 68B.

Storage timing signal interconnect layer 64A and gradation digital data interconnect layers 67A, 68A, and storage timing signal interconnect layer 64B and gradation digital data interconnect layers 67B, 68B are electrically connected to each other by via contacts 64C, 67C, 68C extending through the second interlayer insulating film disposed therebetween.

Distances a, b in the horizontal direction on the sheet of FIG. 9 between confronting sides of holding capacitor C and gradation digital data interconnect layer 67B and confronting sides of holding capacitor C and storage timing signal interconnect layer 64B are 2 μm or more. As shown in FIG. 9, the semiconductor device according to the present embodiment has n unit areas 60 including respective 1-bit DCC circuits, which correspond to reference currents and gradation digital data at the same levels, in the (x+1)-bit (3-bit in the present embodiment) DCC circuits corresponding to the sub pixels of the same colors, in n DCC circuit blocks, all the components including interconnects of n unit areas 60 being arranged in the same layout and shape in the sequence of the n DCC circuit blocks from the left to right of FIG. 9.

As described above with reference to the timing chart shown in FIG. 7, in the current storage period, the three 1-bit DCC circuits making up each 3-bit DCC circuit store voltages corresponding to reference currents depending on the current capability of transistors Tr1 by operating to charge transistor Tr1 between its gate and source and holding capacitor C to hold the gate voltages of transistors Tr1 through the reference currents flow, when three reference currents whose values are I, Ix2, Ix22 generated by the reference current generating circuit flow between the drains and sources of transistors Tr1, which are current drive/storage transistors in the three 1-bit DCC circuits in synchronism with storage timing signal MSk.

Then, in the current output period, the three 1-bit DCC circuits output currents whose values are 0 or I, 0 or Ix2, 0 or Ix22 according to the gradation digital data that are input, so that each 3-bit DCC circuit can output a current whose value is either one of eight values 0, I, Ix2, Ix3, Ix4, Ix5, Ix6, Ix7.

Consequently, the accuracy and/or variation of the output current value of the 3-bit DCC circuit depends upon the accuracy and/or variation of voltages at the time at least the 1-bit DCC circuits of the 3-bit DCC circuit store the voltages corresponding to the reference currents in the current storage period. According to the present embodiment, as described above, all the components including interconnects of unit areas 60 including 1-bit DCC circuits are arranged in the same layout and shape in the sequence of the n DCC circuit blocks from the left to right of FIG. 9. Therefore, even if the manufacturing process that is used is directional in the direction of the array of 1-bit DCC circuits, the accuracy of voltages stored in the 1-bit DCC circuits is increased and/or voltages stored in the 1-bit DCC circuits are prevented from varying.

The same layout of interconnects such as gradation digital data interconnects and storage timing signal interconnects in all the unit areas means that it is possible to suppress variations of the output current values due to variations of the capacitances between the interconnects. Furthermore, the same layout and shape of all the components including interconnects in all the unit areas means that interconnects disposed outside of all the unit areas are also of the same layout, thus minimizing errors of supplied voltages due to layout differences between the unit areas.

Gradation digital data interconnect layers 67B, 68B and storage timing signal interconnect layer 64B, which are disposed adjacent to holding capacitor C in the 1-bit DCC circuit region, which is made up of the highly doped N-type poly-Si region, the first interconnect layer, and the first interlayer insulating film interposed therebetween, for holding the voltage corresponding to the reference current in the voltage holding period, are provided by the second interconnect layer that is different from the first interconnect layer. Therefore, the capacitance values between the electrodes of holding capacitor C, gradation digital data interconnect 64, and storage timing signal interconnects 67, 68 can be reduced. Noise due to variations of the gradation digital data and/or the storage timing signal that is input are thus prevented from being introduced from the gradation digital data interconnect and/or the storage timing signal interconnects into holding capacitor C.

The above noise reduction capability is further increased by forming the gradation digital data interconnect and the storage timing signal interconnects such that the distances between them and holding capacitor C is 2 μm or more.

Because the voltage stored in the holding capacitor is prevented from varying, the accuracy of the current outputs of the 1-bit DCC circuits and hence the current output of the 3-bit DCC circuit is increased, and/or those current outputs are prevented from varying.

As the distances between the holding capacitor and the gradation digital data interconnect and the storage timing signal interconnects is increased, the effect that digital signals propagating through the gradation digital data interconnect and the storage timing signal interconnects have on the holding capacitor is reduced. Consequently, the requirement that the distances between the holding capacitor and the gradation digital data interconnect and the storage timing signal interconnects be strictly identical in all the unit areas is reduced.

The layout of the unit area shown in FIG. 9 is the same for other 1-bit DCC circuits. Furthermore, modifications thereof are generally applicable to the conventional current-program-type data line driver and other semiconductor devices having a function to hold a voltage corresponding to a reference current and to provide a current according to the voltage that is held.

2nd Embodiment

Figure 10:
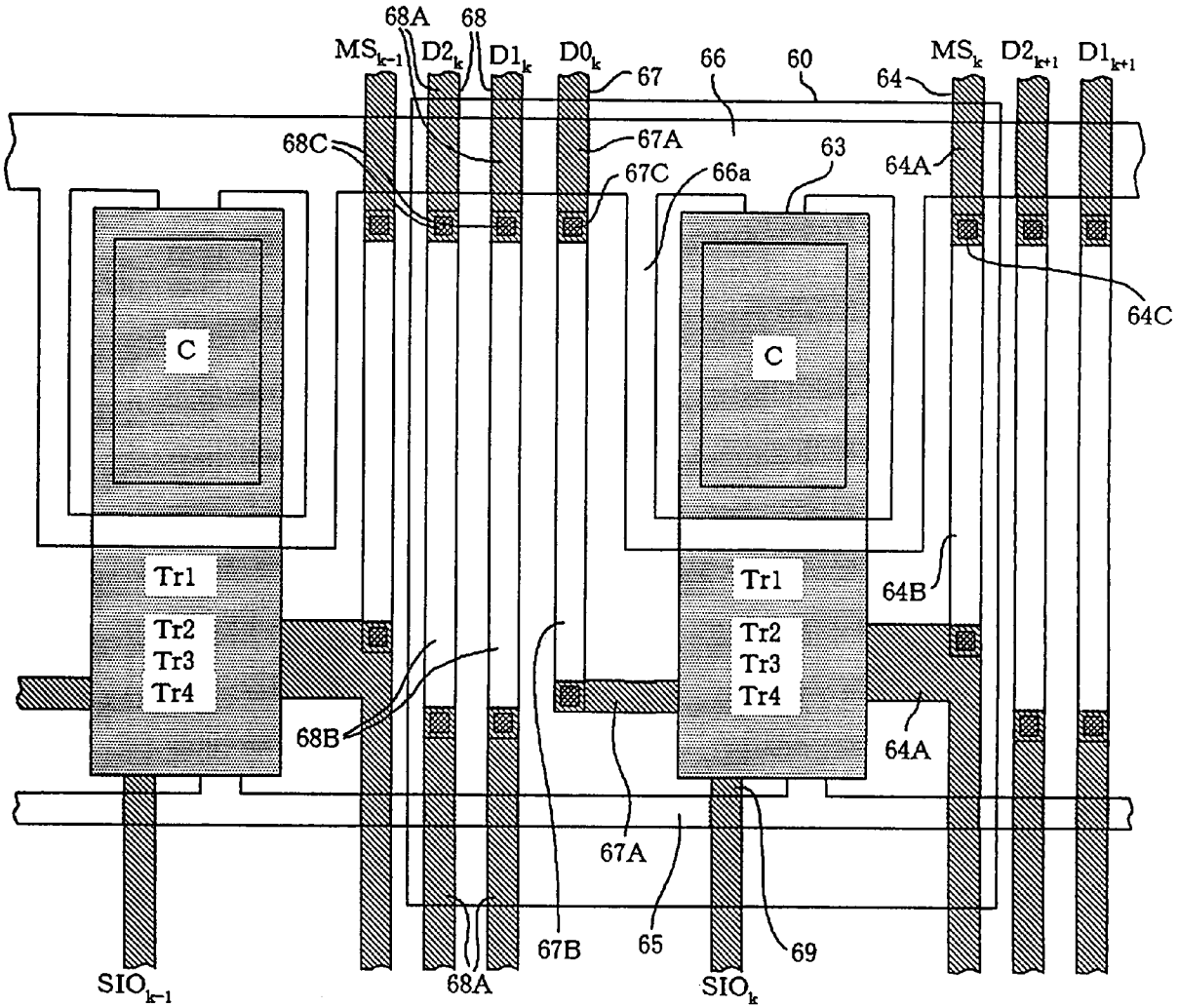
FIG. 10 is view showing the layout of a unit area of a semiconductor device according to a second embodiment of the present invention.

FIG. 10 shows the layout of a unit area of a semiconductor device according to a second embodiment of the present invention. Those parts shown in FIG. 10 which are identical to those shown in FIG. 9 are denoted by identical reference characters, and will not be described in detail below. The unit area of the semiconductor device according to the second embodiment differs from the unit area of the semiconductor device according to the first embodiment shown in FIG. 9 in that interconnect 66*a* extending from GND interconnect 66 which is provided by the second interconnect layer as with gradation digital data interconnect layers 67B, 68B and storage timing signal interconnect layer 64B is disposed around and adjacent to holding capacitor C in the 1-bit DCC circuit region for holding the voltage corresponding to the reference current.

Since the effect that gradation digital data interconnect layers 67B, 68B and storage timing signal interconnect layer 64B has on holding capacitor C is shielded by interconnect 66*a*, holding capacitor C can hold the voltage stably. Therefore, the 1-bit DCC circuit and hence the 3-bit DCC circuit are capable of supplying a highly accurate current. Other details of the operation of the semiconductor device according to the second embodiment are the same as those of the semiconductor device according to the first embodiment.

Interconnect 66*a* surrounding holding capacitor C may not necessarily be connected to GND interconnect 66. Interconnect 66*a* may be an interconnect which can be supplied with a constant voltage that remains unchanged even when signals on gradation digital data interconnect layers 67B, 68B and storage timing signal interconnect layer 64B are varied. Interconnect 66*a* may not necessarily be disposed in the second interconnect layer, but may be disposed between the first interconnect layer and the second interconnect layer. Interconnect 66*a* may not necessarily fully surround holding capacitor C, but may be positioned between gradation digital data interconnect layers 67B, 68B and storage timing signal interconnect layer 64B and holding capacitor C.

3rd Embodiment

Figure 11:
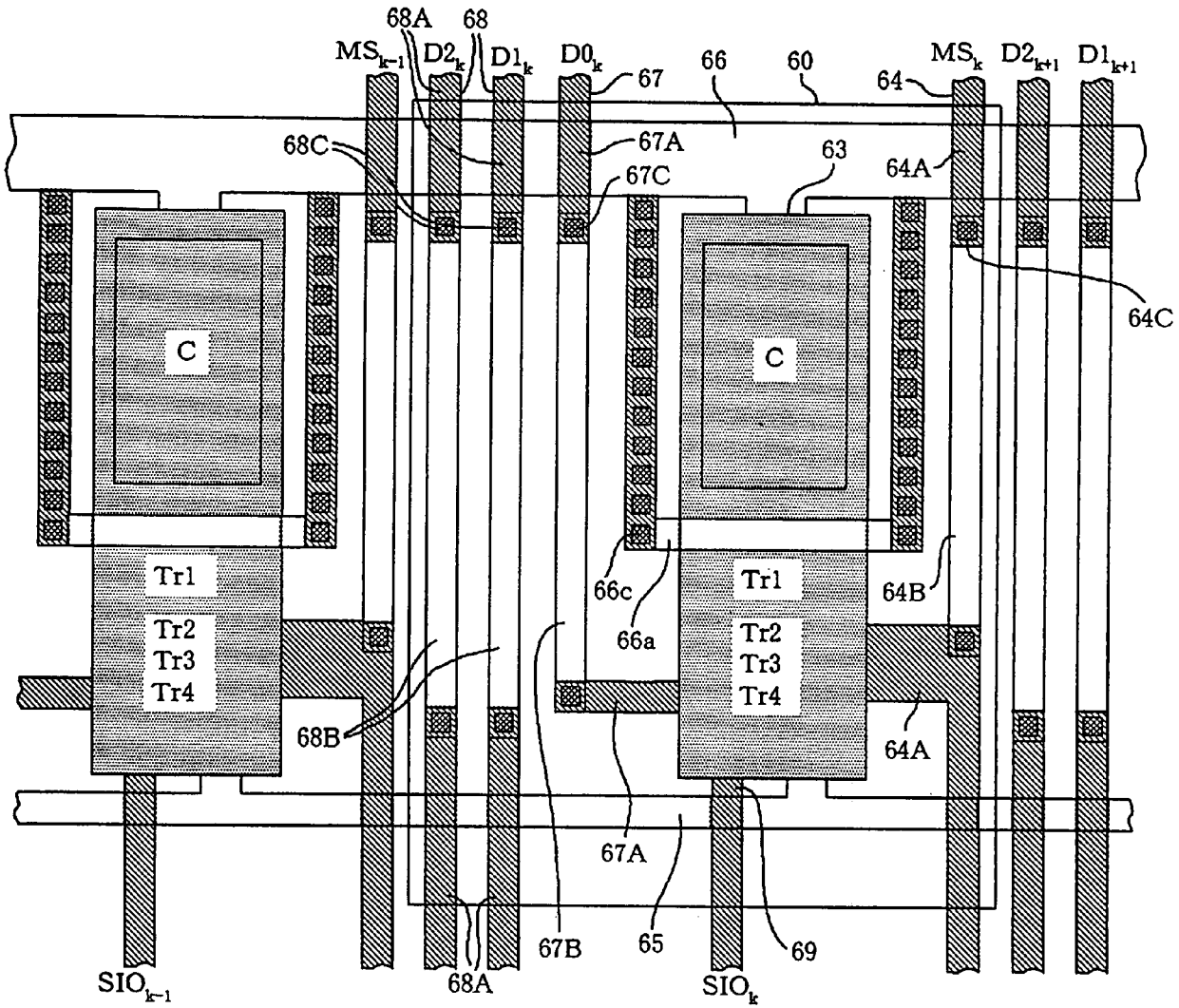
FIG. 11 is view showing the layout of a unit area of a semiconductor device according to a third embodiment of the present invention.

FIG. 11 shows the layout of a unit area of a semiconductor device according to a third embodiment of the present invention. Those parts shown in FIG. 11 which are identical to those shown in FIG. 10 are denoted by identical reference characters, and will not be described in detail below. The unit area of the semiconductor device according to the third embodiment differs from the unit area of the semiconductor device according to the second embodiment shown in FIG. 10 in that not only interconnect 66*a* extending from GND interconnect 66 which is provided by the second interconnect layer as with gradation digital data interconnect layers 67B, 68B and storage timing signal interconnect layer 64B is disposed around and adjacent to holding capacitor C, but also an interconnect provided by the first interconnect layer as with the electrode of holding capacitor C opposite to the substrate is disposed beneath interconnect 66*a*, and those two interconnects are electrically connected to each other by via contacts 66*c* extending through the second interlayer insulating layer therebetween.

Interconnect 66*a* and the other interconnect electrically connected thereto by via contacts 66*c* are more effective in shielding the effect that gradation digital data interconnect layers 67B, 68B and storage timing signal interconnect layer 64B has on holding capacitor C.

4th Embodiment

Figure 12:
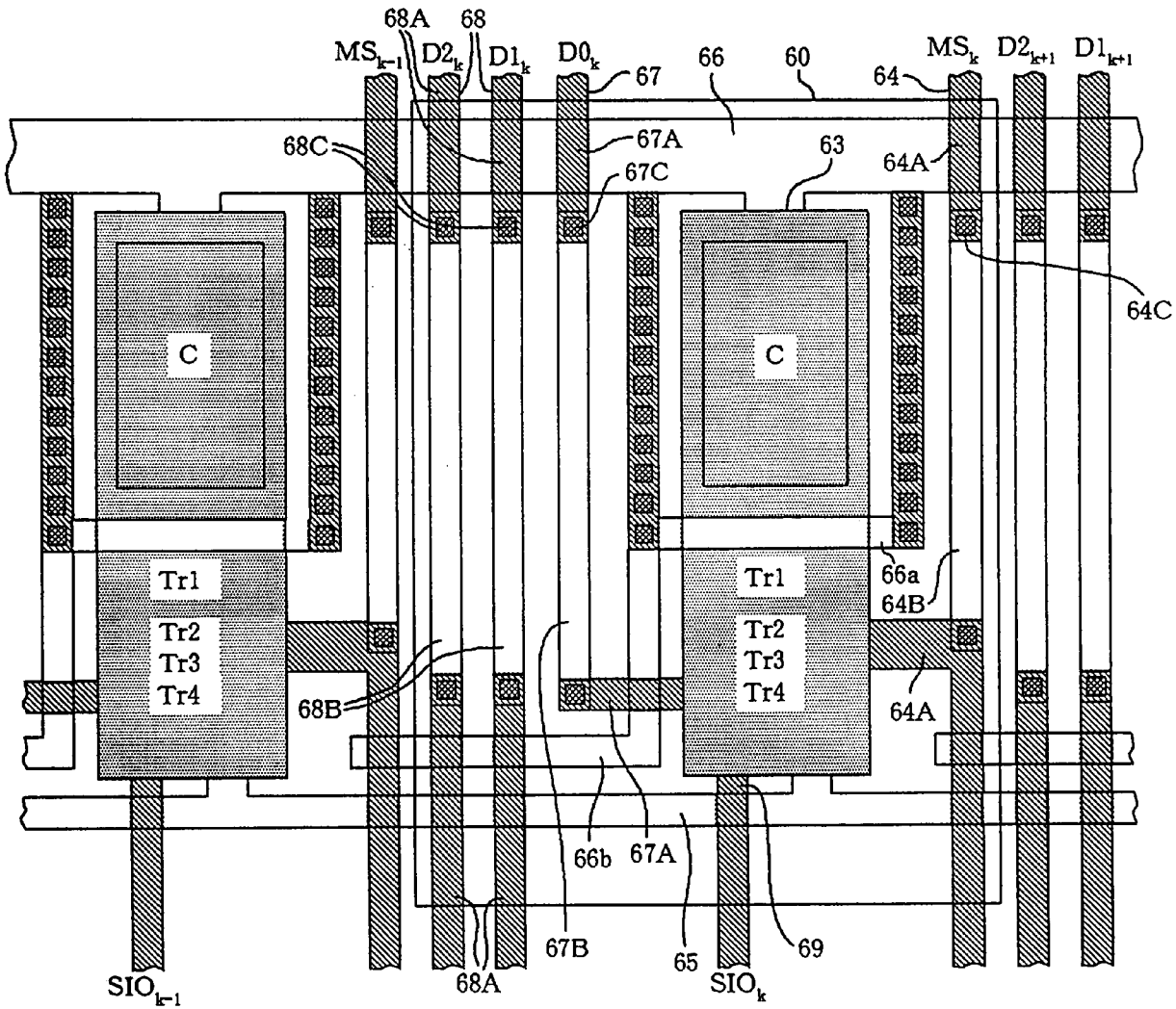
FIG. 12 is view showing the layout of a unit area of a semiconductor device according to a fourth embodiment of the present invention.

FIG. 12 shows the layout of a unit area of a semiconductor device according to a fourth embodiment of the present invention. Those parts shown in FIG. 12 which are identical to those shown in FIG. 11 are denoted by identical reference characters, and will not be described in detail below. The unit area of the semiconductor device according to the fourth embodiment differs from the unit area of the semiconductor device according to the third embodiment shown in FIG. 11 in that interconnect 66*b* which is provided by the second interconnect layer as with reference current interconnect 65, gradation digital data interconnect layers 67B, 68B and storage timing signal interconnect layer 64B extends from interconnect 66*a* and is disposed adjacent to reference current interconnect 65 and between reference current interconnect 65, gradation digital data interconnect layers 67B, 68B and storage timing signal interconnect layer 64B.

With the above arrangement, of all the capacitances between reference current interconnect 65 and the other interconnect, the capacitances between reference current interconnect 65, gradation digital data interconnect layers 67B, 68B and storage timing signal interconnect layer 64B have their proportion lowered, so that noise introduced from gradation digital data interconnect layers 67B, 68B and storage timing signal interconnect layer 64B into reference current interconnect 65 can be reduced. Therefore, since the reference current is prevented from varying due to noise at the time the 1-bit DCC circuit holds the voltage corresponding to the reference current, the accuracy of the voltage corresponding to the reference current is increased. Accordingly, the accuracy of the current outputs of the 1-bit DCC circuits and hence the current output of the 3-bit DCC circuit is increased, and/or those current outputs are prevented from varying, more effectively than with the first through third embodiments.

Interconnect 66*b* disposed adjacent to reference current interconnect 65 may not necessarily be connected to interconnect 66*a*, but may be an interconnect which can be supplied with a constant voltage that remains unchanged even when signals on gradation digital data interconnect layers 67B, 68B and storage timing signal interconnect layer 64B are varied.

5th Embodiment

Figure 13:
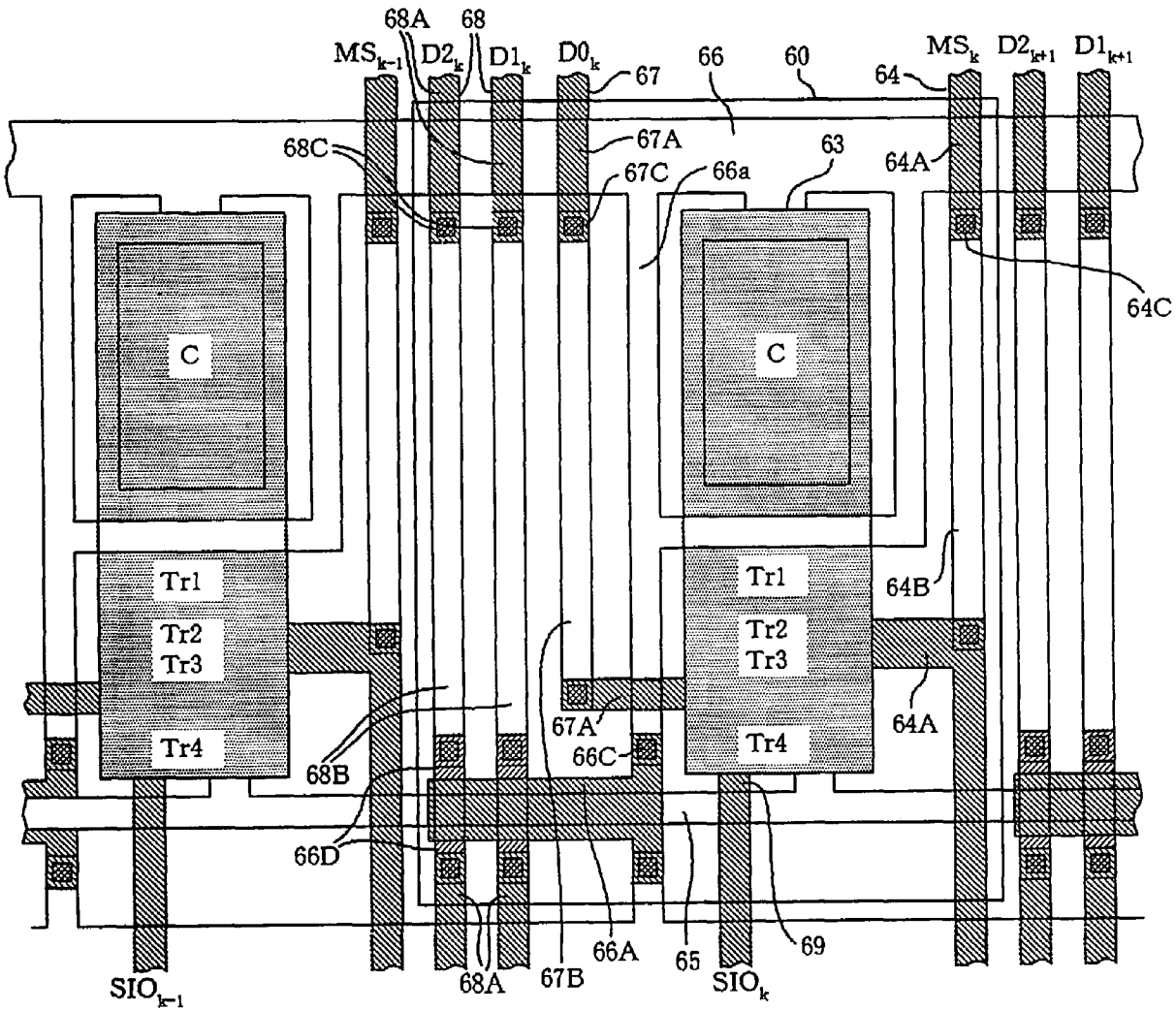
FIG. 13 is view showing the layout of a unit area of a semiconductor device according to a fifth embodiment of the present invention.

FIG. 13 shows the layout of a unit area of a semiconductor device according to a fifth embodiment of the present invention. Those parts shown in FIG. 13 which are identical to those shown in FIG. 10 are denoted by identical reference characters, and will not be described in detail below. The unit area of the semiconductor device according to the fifth embodiment differs from the unit area of the semiconductor device according to the second embodiment shown in FIG. 10 in that the portion of gradation digital data interconnect 68 which extends below reference current interconnect 65 is not provided by the first interconnect layer, but provided by gradation digital data interconnect layer 68D in the form of a highly doped N-type poly-Si layer as a lowermost layer, and interconnect 66A provided by the first interconnect layer and electrically connected to interconnect 66*a* provided by the second interconnect layer at the ground potential by via contacts 66C is disposed between and near reference current interconnect 65 and gradation digital data interconnect layer 68D.

According to the present embodiment, interconnect 66A disposed between gradation digital data interconnect layer 68D and reference current interconnect 65 shields the effect that the gradation digital data transmitted through gradation digital data interconnect layer 68D has on the reference current flowing through reference current interconnect 65. Therefore, since the reference current is prevented from varying due to noise at the time the 1-bit DCC circuit holds the voltage corresponding to the reference current, the accuracy of the current outputs of the 1-bit DCC circuits and hence the current output of the 3-bit DCC circuit is increased, and/or those current outputs are prevented from varying, more effectively than with the second embodiment.

The portion of gradation digital data interconnect 68 which extends below reference current interconnect 65 may not be provided by the highly doped N-type poly-Si layer as a lowermost layer, but may be provided by another electrically conductive layer that is formed. Interconnect 66A may not necessarily be connected to interconnect 66*a* at the ground potential, but may be an interconnect which can be supplied with a constant voltage that remains unchanged even when the gradation digital data on gradation digital data interconnect layer 68D are varied. The present embodiment is also applicable to the first embodiment shown in FIG. 9 or the third embodiment shown in FIG. 11.

6th Embodiment

Figure 14:
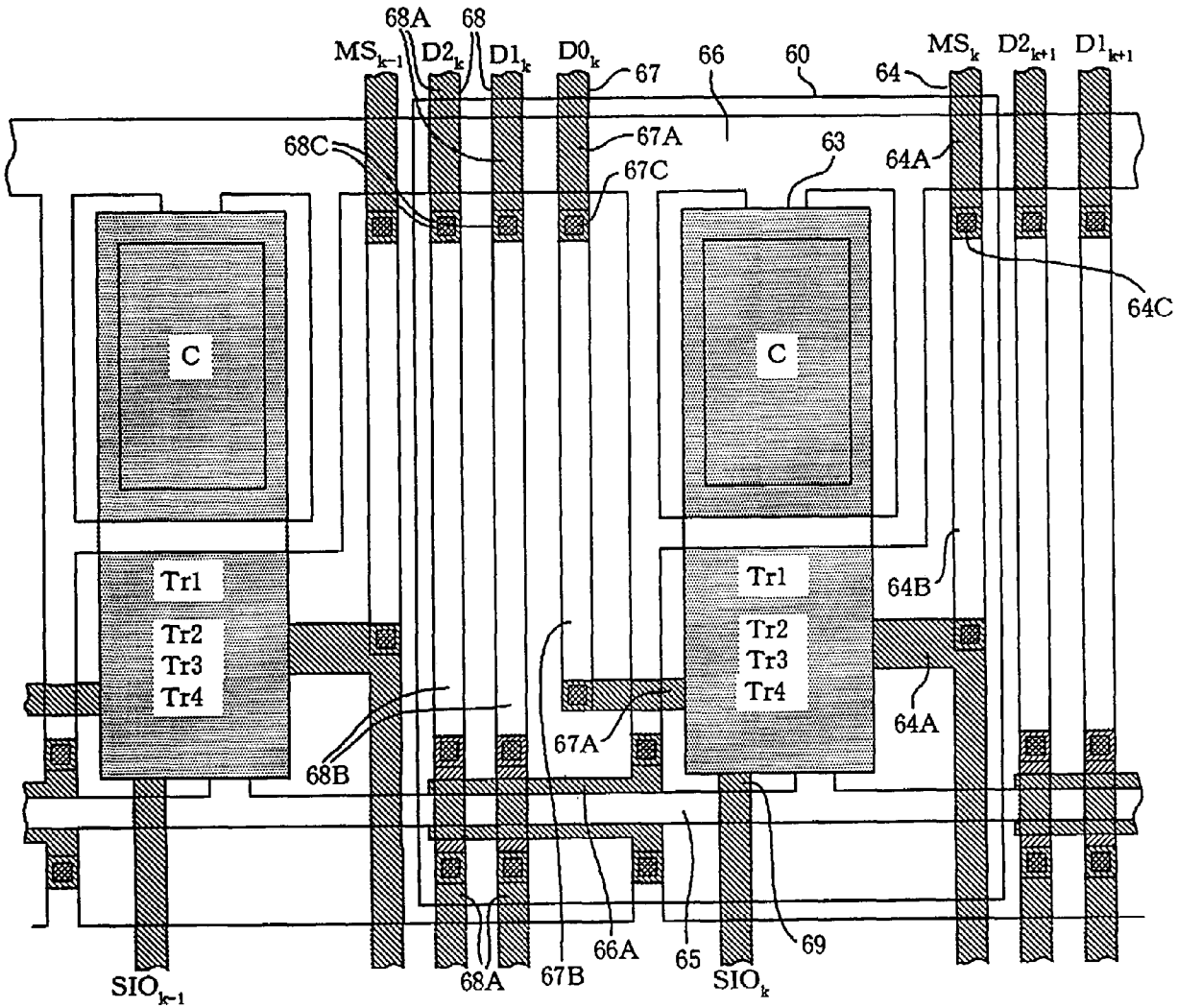
FIG. 14 is view showing the layout of a unit area of a semiconductor device according to a sixth embodiment of the present invention.

FIG. 14 shows the layout of a unit area of a semiconductor device according to a sixth embodiment of the present invention. Those parts shown in FIG. 14 which are identical to those shown in FIG. 13 are denoted by identical reference characters, and will not be described in detail below. The unit area of the semiconductor device according to the sixth embodiment differs from the unit area of the semiconductor device according to the fifth embodiment shown in FIG. 13 in that interconnect 66A is not formed below reference current interconnect 65 in an area where reference current interconnect 65 and gradation digital data interconnect layer 68D confront each other. The semiconductor device according to the sixth embodiment offers the same advantages as the semiconductor device according to the fifth embodiment, and is also more effective to prevent an excessive capacitance from being formed between reference current interconnect 65 and interconnect 66A than with the first through fourth embodiments.

Figure 15:
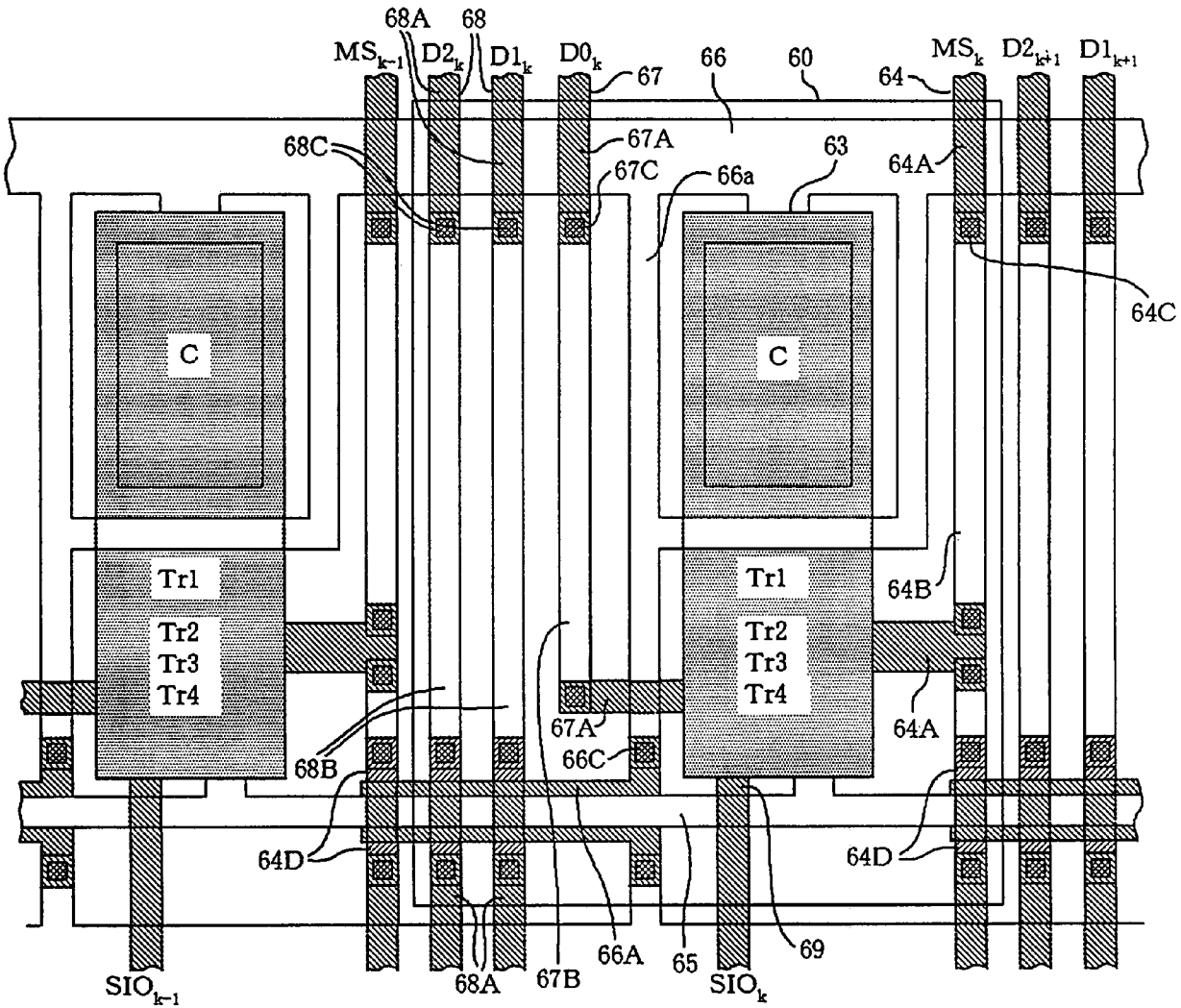
FIG. 15 is view showing the layout of a unit area of another semiconductor device according to a sixth embodiment of the present invention.

As shown in FIG. 15, as with gradation digital data interconnect 68, the portion of storage timing signal interconnect 64 which extends below reference current interconnect 65 may not be provided by the first interconnect layer, but may be provided by storage timing signal interconnect layer 64D in the form of a highly doped N-type poly-Si layer as a lowermost layer, and interconnect 66A provided electrically connected to interconnect 66*a* by via contacts 66C may be disposed between and near reference current interconnect 65 and storage timing signal interconnect layer 64D. This arrangement is effective to shield the effect that the storage timing signal transmitted through storage timing signal interconnect layer 64D has on the reference current flowing through reference current interconnect 65.

7th Embodiment

The semiconductor devices according to the first through sixth embodiments have a function to hold a voltage corresponding to a reference current and to provide a current according to the voltage that is held. A semiconductor devices according to a seventh embodiment has a function to hold a voltage serving as a reference and to output a voltage according to the voltage that is held.

Figure 16:
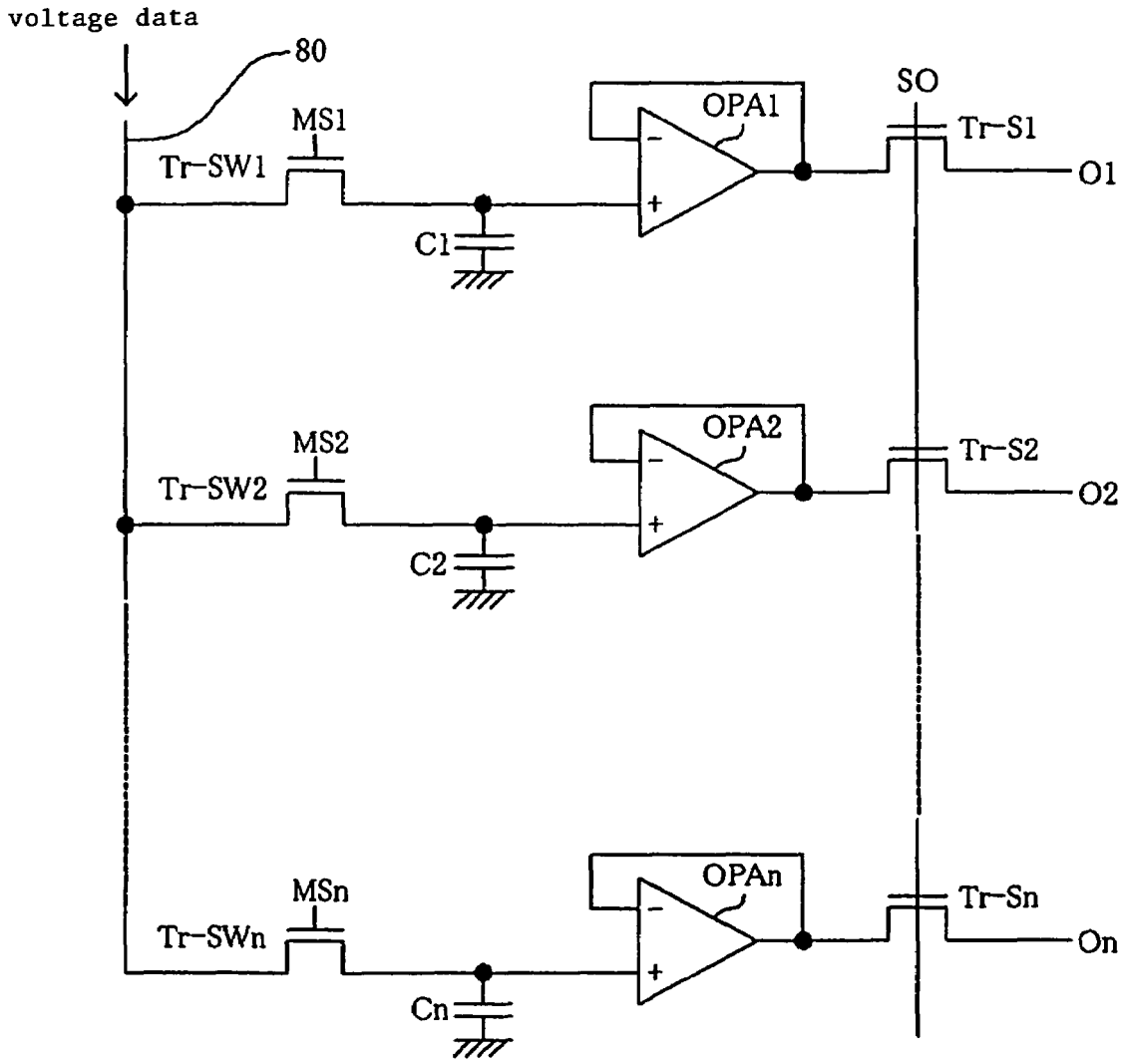
FIG. 16 is view showing the layout of a unit area of a semiconductor device according to a seventh embodiment of the present invention.

FIG. 16 shows the layout of a unit area of a semiconductor device according to a seventh embodiment of the present invention. As sown in FIG. 16, the semiconductor devices according to the seventh embodiment has n functional blocks for holding an analog voltage that is input with a holding capacitor and outputting the voltage that is held through a voltage follower. For example, the first functional block has storage timing transistor Tr-SW1 in the form of an N-channel FET that is controlled by storage timing signal MS1, operational amplifier OPA1 having a noninverting input terminal connected to the source of storage timing transistor Tr-SW1 and one electrode of holding capacitor C1 and serving as a voltage follower, and output switching transistor Tr-S1 in the form of an N-channel FET having a drain connected to the output terminal of operational amplifier OPA1, output switching transistor Tr-S1 being controlled by output switching signal SO. The other electrode of holding capacitor Cl is connected to ground potential. An analog voltage is inputted from an external circuit to the drain of storage timing transistor Tr-SW1.

Figure 17:
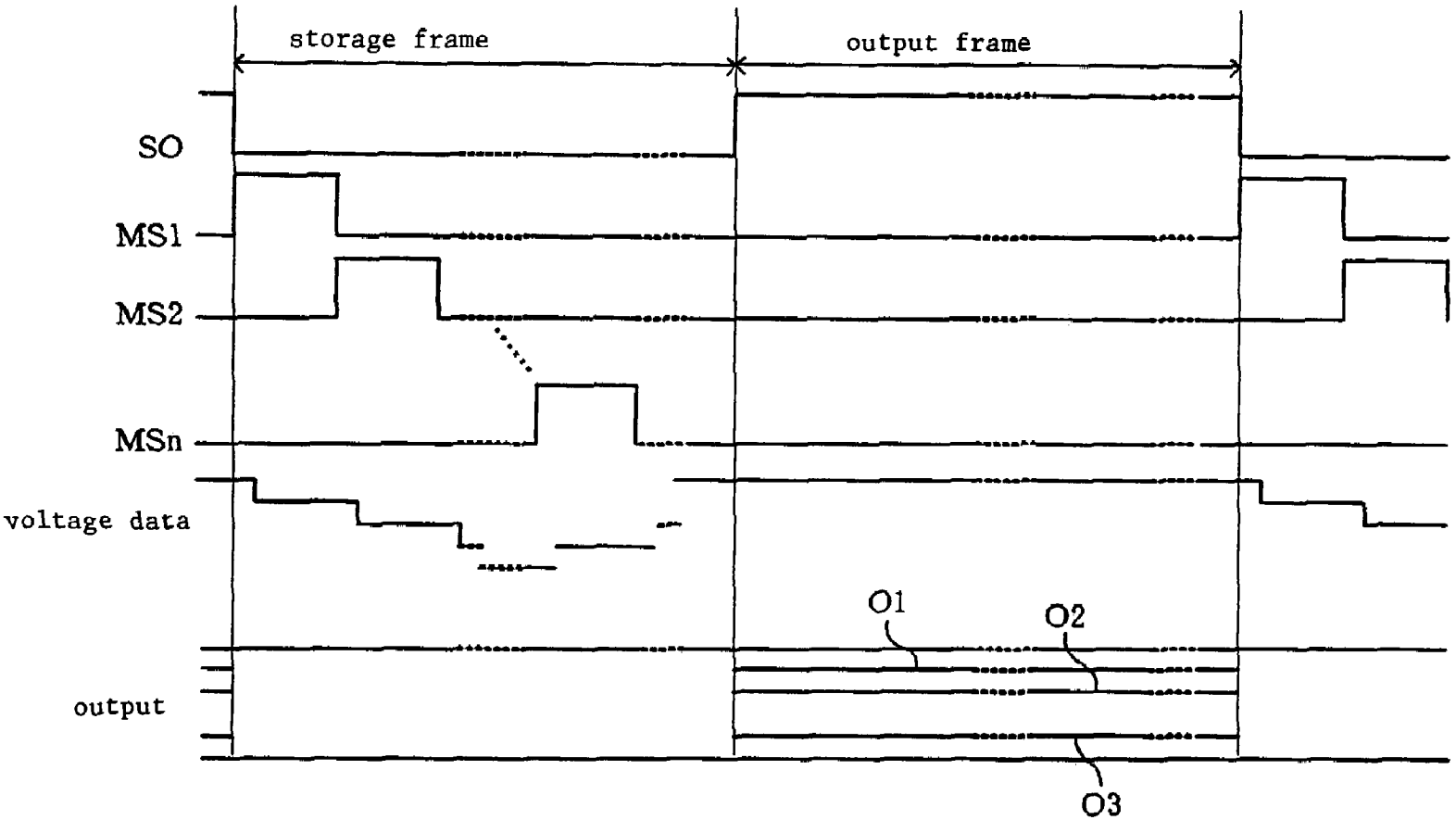
FIG. 17 is a timing chart which is illustrative of operation of the semiconductor device shown in FIG. 16.

FIG. 17 is a timing chart which is illustrative of operation of the semiconductor device shown in FIG. 16. In one frame (storage frame in FIG. 17), output switching signal SO is of a low level. When this frame starts, storage timing signal MS1 supplied to the gate of storage timing transistor Tr-SW1 of the first functional block goes high, and voltage data interconnect 80 is supplied with a gradation analog voltage (voltage data) from an external circuit which is to be stored in the first functional block. Since storage timing transistor Tr-SW1 is turned on, the gradation analog voltage is held by holding capacitor C1. When the gradation analog voltage is held by holding capacitor C1, storage timing signal MS1 goes low.

Then, storage timing signal MS2 supplied to the gate of storage timing transistor Tr-SW2 of the second functional block goes high, and voltage data interconnect 80 is supplied with a gradation analog voltage (voltage data) from the external circuit which is to be stored in the second functional block. The gradation analog voltage is held by holding capacitor C2 in the same manner as described above. Subsequently, the above process is repeated until storage timing signal MSn supplied to the gate of storage timing transistor Tr-SWn of the nth functional block goes high, and the gradation analog voltage to be stored in the nth functional block is held by holding capacitor Cn.

According to the above process, the gradation analog voltages to be stored in the respective functional blocks are held by the respective holding capacitors of the first through nth functional blocks in one storage frame. During this storage frame, since output switching signal SO is of a low level, outputs O1 through On of the functional blocks are zero.

In the next frame (output frame in FIG. 17), output switching signal SO is of a high level. During this frame, all storage timing signals MS1 through MSn are of a low level. Since all output switching transistors Tr-S1 through Tr-Sn of the first through nth functional blocks are turned on, the gradation analog voltages held by holding capacitors C1 through Cn are output as outputs O1 through On. At this time, since operational amplifiers OPA1 through OPAn serve as voltage followers which are of a high input impedance and a low output impedance, outputs O1 through On are output at a high speed as stable gradation analog voltages which are not affected by the load.

The above operation is repeated to cause the semiconductor device shown in FIG. 16 to store gradation analog voltages in a storage frame which are to be output in the next output frame, and to output the gradation analog voltages in the output frame which have been stored in the preceding storage frame.

8th Embodiment

Figure 18:
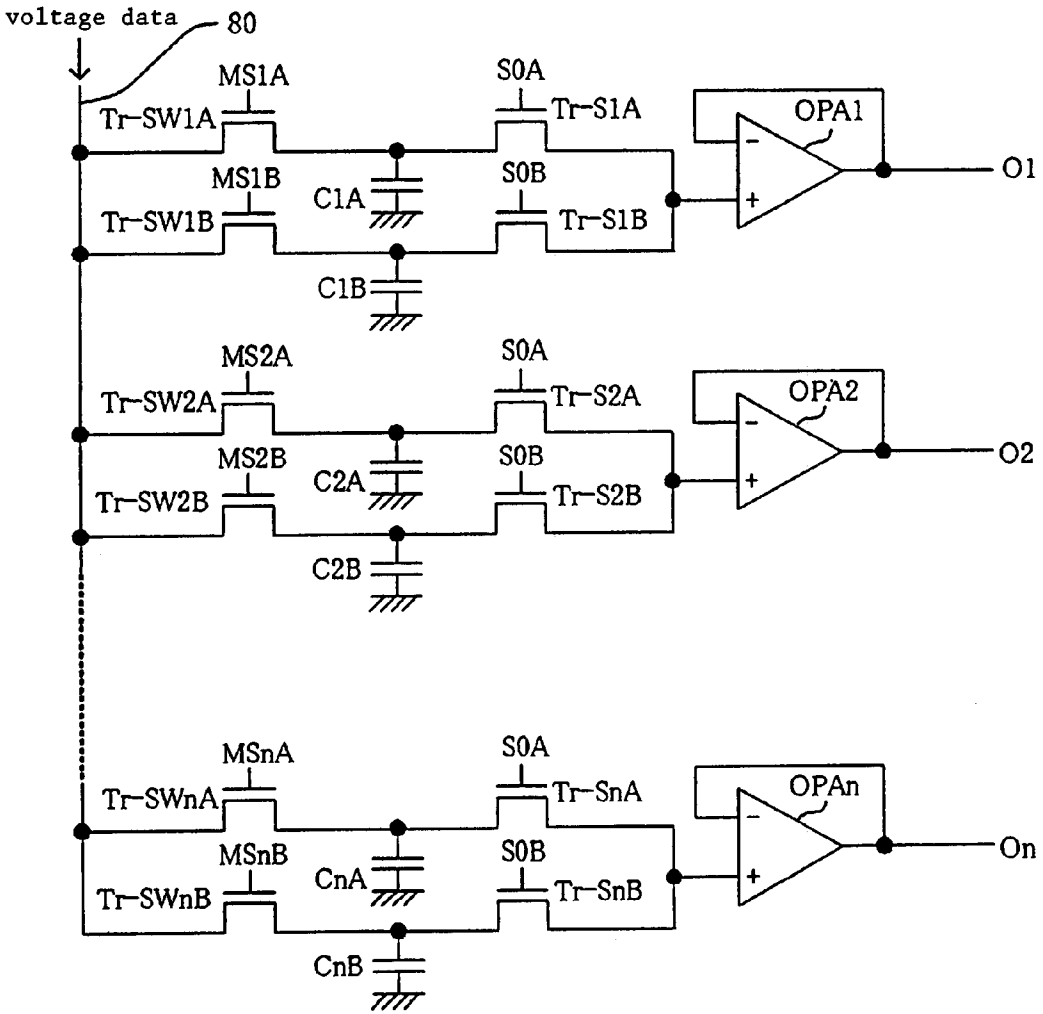
FIG. 18 is a circuit diagram of a semiconductor device according to an eighth embodiment of the present invention.

FIG. 18 shows the layout of a unit area of a semiconductor device according to an eighth embodiment of the present invention. Those parts shown in FIG. 18 which are identical to those shown in FIG. 16 are denoted by identical reference characters, and will not be described in detail below. The semiconductor device according to the eighth embodiment differs from the semiconductor device according to the seventh embodiment shown in FIG. 16 in that each functional block has two parallel storage sections each comprising a storage timing transistor and a holding capacitor that are connected in series to each other, and an output switching transistor connected between each of the holding capacitors and the noninverting input terminal of the operational amplifier.

Figure 19:
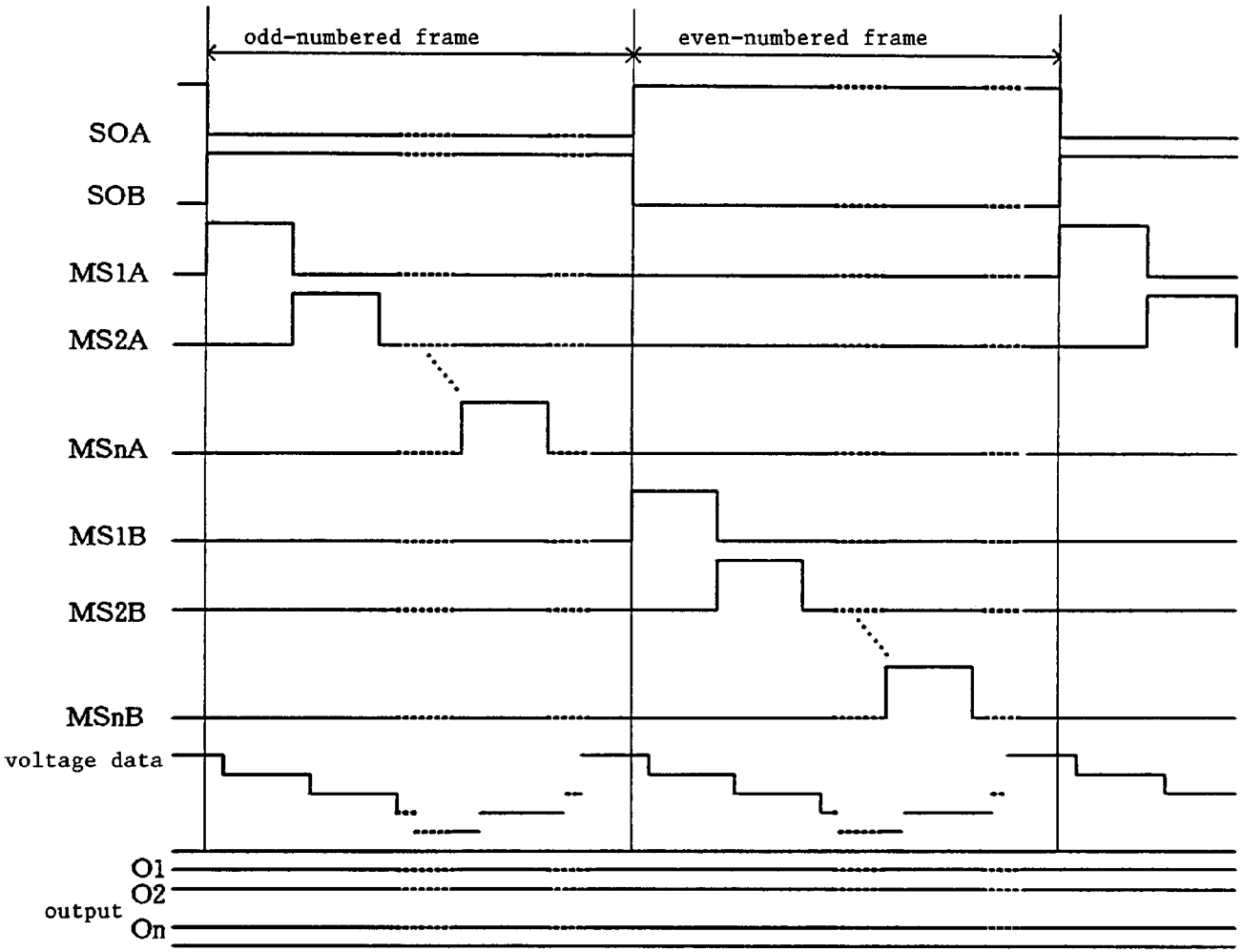
FIG. 19 is a timing chart which is illustrative of operation of the semiconductor device shown in FIG. 18.

FIG. 19 is a timing chart which is illustrative of operation of the semiconductor device shown in FIG. 18. In an odd-numbered frame, output switching signals SOA, SOB are of a low level and a high level, respectively, and in an even-numbered frame, output switching signals SOA, SOB are of a high level and a low level, respectively. In the odd-numbered frame, storage timing signals MS1A, MS2A, . . . , MSnA supplied to the respective gates of storage timing transistors Tr-SW1A, Tr-SW2A, . . . , Tr-SWnA successively go high, as with the seventh embodiment, storing gradation digital voltages in respective holding capacitors C1A, C2A, . . . , CnA.

Since output switching transistors Tr-S1A, Tr-S2A, . . . , Tr-SnA are turned off, the gradation digital voltages stored in respective holding capacitors C1A, C2A, . . . , CnA are not output. During this frame, storage timing signals MS1B, MS2B, . . . , MSnB supplied to the respective gates of storage timing transistors Tr-SW1B, Tr-SW2B, . . . , Tr-SWnB are of a low level. As output switching transistors Tr-S1B, Tr-S2B, . . . , Tr-SnB are turned on, the storage digital voltages held in respective holding capacitors C1B, C2B, . . . , Cnb in the preceding even-numbered frame are output as outputs O1, O2, . . . , On. In an even-numbered frame, storage timing transistors Tr-SWkA and Tr-SWkB (k is a positive integer equal to or smaller than n), holding capacitors CkA and CkB, and output switching transistors Tr-SkA and SkB operate in a manner opposite to the manner in an odd-numbered frame, outputting gradation analog voltages stored in an odd-numbered frame and storing gradation analog voltages to be outputted in the next odd-numbered frame.

According to the present embodiment, it is possible to output gradation analog voltages in all frames.

The layouts of the semiconductor devices according to the first through sixth embodiments shown in FIGS. 9 through 15 may be applied to the layouts of the semiconductor devices according to the seventh and eighth embodiments shown in FIGS. 16 and 18 to increase the accuracy of the output voltage thereof and/or prevent the output voltage from varying.

The first through eighth embodiments may be combined to realize a semiconductor device capable of producing outputs that are more accurate and suffer less variations. These semiconductor devices may be constructed by forming bulk transistors on a silicon substrate.

While preferred embodiments of the present invention have been described using specific terms, such description is for illustrative purposes only, and it is to be understood that changes and variations may be made without departing from the spirit or scope of the following claims.

What is claimed is:

1. A semiconductor device comprising, on a principal surface of a substrate:

a plurality of functional blocks each having a function to hold either a voltage determined by a current supplied from a current source or a voltage supplied from a voltage source and to supply a current or a voltage determined by the voltage thus held to an external circuit, a plurality of unit areas each having one of said functional blocks, supply interconnects for supplying the current supplied from the current source or the voltage supplied from the voltage source to said functional block, and signal interconnects for propagating a signal other than the current supplied from the current source or the voltage supplied from the voltage source, said unit areas being arranged in at least one direction on said principal surface, said signal interconnects including identical numbers of interconnects that connect to the functional block, said signal interconnects being disposed respectively on left and right sides of said functional block and extending in said one direction over said unit areas:

wherein each of the unit areas comprising a layout of the functional block and respective portions of the supply and signal interconnects, the respective layouts of at least two adjacent unit areas being identical.

2. A semiconductor device according to claim 1, wherein said functional blocks and said signal interconnects in said unit areas are arranged in the same shape and the same layout in said unit areas.

3. A semiconductor device according to claim 1, wherein said signal interconnects are disposed in regions that are present in a plurality of different planes parallel to said principal surface of the substrate.

4. A semiconductor device according to claim 1, further comprising an interconnect disposed in the same plane as said supply interconnects and adjacent to said supply interconnects, said interconnect being maintained at a constant potential.

5. The semiconductor device of claim 1, wherein the signal interconnects are disposed on a first and a second interconnect layer;

wherein each of the functional blocks comprises a capacitor, the capacitor comprising a N-type poly-Si layer disposed on the substrate, the first interconnect layer, and an insulating film sandwiched between the N-type poly-Si layer and the first interconnect layer, wherein the first and second interconnect layers are disposed in a different plane parallel to the principal surface, the first interconnect layer being more proximal to the principal surface than the second interconnect layer.

6. The semiconductor device of claim 1, wherein the signal interconnects that connect to the functional block comprise a space of at least 2 microns between a confronting side of a capacitor and the signal interconnects.

7. A semiconductor device comprising, on a principal surface of a substrate:

a plurality of functional blocks each having a function to hold either a voltage determined by a current supplied from a current source or a voltage supplied from a voltage source and to supply a current or a voltage determined by the voltage thus held to an external circuit, said semiconductor device having a plurality of unit areas each having one of said functional blocks, supply interconnects for supplying the current supplied from the current source or the voltage supplied from the voltage source to said functional block, and signal interconnects for propagating a signal other than the current supplied from the current source or the voltage supplied from the voltage source, said unit areas being arranged in at least one direction on said principal surface, said signal interconnects including identical numbers of interconnects, said signal interconnects being disposed respectively on left and right sides of said functional block and extending in said one direction over said unit areas;

wherein at least a portion of said signal interconnects is disposed in a region adjacent to at least one component for holding said voltage in said functional blocks, in a second plane different from a first plane parallel to said principal surface of the substrate, said component having one electrode disposed in said first plane.

8. A semiconductor device according to claim 7, further comprising a shield interconnect disposed in at least one plane between said first plane and said second plane between said component and said signal interconnect in said second plane, said shield interconnect being maintained at a constant potential.

9. A semiconductor device according to claim 8, wherein the shield interconnect is disposed in said second plane.

10. A semiconductor device according to claim 9, further comprising a shield interconnect electrically connected to said shield interconnect in said second plane and disposed in said first plane.

11. A semiconductor device according to claim 9, wherein said shield interconnect in said second plane is disposed in surrounding relation to said component.

12. A semiconductor device according to claim 7, wherein said supply interconnects are disposed in said second plane.

13. A semiconductor device comprising, on a principal surface of a substrate:

a plurality of functional blocks each having a function to hold either a voltage determined by a current supplied from a current source or a voltage supplied from a voltage source and to supply a current or a voltage determined by the voltage thus held to an external circuit, said semiconductor device having a plurality of unit areas each having one of said functional blocks, supply interconnects for supplying the current supplied from the current source or the voltage supplied from the voltage source to said functional block, and signal interconnects for propagating a signal other than the current supplied from the current source or the voltage supplied from the voltage source, said unit areas being arranged in at least one direction on said principal surface, said signal interconnects including identical numbers of interconnects, said signal interconnects being disposed respectively on left and right sides of said functional block and extending in said one direction over said unit areas;

wherein at least portions of said supply interconnects and said signal interconnects have crossing areas which cross each other as viewed in an axial direction perpendicular to said principal surface of the substrate, and which occupy different planes parallel to said principal surface of the substrate, further comprising an interconnect disposed in a plane disposed between and different from said supply interconnects and said signal interconnects, said interconnect being maintained at a constant potential.

14. A semiconductor device comprising, on a principal surface of a substrate:

a plurality of functional blocks each having a function to hold either a voltage determined by a current supplied from a current source or a voltage supplied from a voltage source and to supply a current or a voltage determined by the voltage thus held to an external circuit, said semiconductor device having a plurality of unit areas each having one of said functional blocks, supply interconnects for supplying the current supplied from the current source or the voltage supplied from the voltage source to said functional block, and signal interconnects for propagating a signal other than the current supplied from the current source or the voltage supplied from the voltage source, said unit areas being arranged in at least one direction on said principal surface, said signal interconnects including identical numbers of interconnects, said signal interconnects being disposed respectively on left and right sides of said functional block and extending in said one direction over said unit areas;

wherein each of said functional blocks has at least one switch or a group of at least two series-connected switches, and a capacitor, one terminal of said switch or an outermost terminal of the group of switches is electrically connected to one electrode of said capacitor, with the other electrode thereof being maintained at a constant potential, and the other terminal of said switch or the other outermost terminal of the group of switches is electrically connected to said supply interconnect, and wherein when said switch or said group of switches is closed, the current is supplied from said current source or the voltage is supplied from said voltage source to charge said capacitor, and thereafter said switch or said group of switches is opened to cause said capacitor to hold the voltage determined by the current supplied from said current source or the voltage supplied from said voltage source.

15. A semiconductor device according to claim 14, wherein said switch or said group of switches comprises a transistor or transistors.

16. A display apparatus comprising:

a semiconductor device as a driver for a display unit, the semiconductor device comprising, on a principal surface of a substrate a plurality of functional blocks each having a function to hold either a voltage determined by a current supplied from a current source or a voltage supplied from a voltage source and to supply a current or a voltage determined by the voltage thus held to an external circuit, a plurality of unit areas each having one of said functional blocks, supply interconnects for supplying the current supplied from the current source or the voltage supplied from the voltage source to said functional block, and signal interconnects for propagating a signal other than the current supplied from the current source or the voltage supplied from the voltage source, said unit areas being arranged having a major axis oriented in at least one direction on said principal surface, said signal interconnects including identical numbers of interconnects, said signal interconnects being disposed respectively on left and right sides of said functional block and extending in said one direction over said unit areas.

17. A display apparatus 16, wherein said display unit and said semiconductor device are disposed on one substrate.

18. A drive circuit for a display apparatus comprising, on a principal surface of a substrate:

a plurality of functional blocks each having a function to hold either a voltage determined by a current supplied from a current source or a voltage supplied from a voltage source and to supply a current or a voltage determined by the voltage thus held to an external circuit, a plurality of unit areas each having one of said functional blocks, supply interconnects for supplying the current supplied from the current source or the voltage supplied from the voltage source to said functional block, and signal interconnects for propagating a signal other than the current supplied from the current source or the voltage supplied from the voltage source, said unit areas being arranged in at least one direction on said principal surface, said signal interconnects including identical numbers of interconnects that connect to the functional block, said signal interconnects being disposed respectively on left and right sides of said functional block and extending in said one direction over said unit areas;

wherein each of the unit areas comprising a layout of the functional block and respective portions of the supply and signal interconnects, the respective layouts of at least two adjacent unit areas being identical.

* * * * *